US011303016B2

(12) United States Patent
Pera et al.

(10) Patent No.: US 11,303,016 B2
(45) Date of Patent: Apr. 12, 2022

(54) MULTI-SECTOR ANTENNAS

(71) Applicant: Ubiquiti Inc., New York, NY (US)

(72) Inventors: Robert J. Pera, Seattle, WA (US); John R. Sanford, Escondido, CA (US); Yanwei Sun, San Marcos, CA (US)

(73) Assignee: Ubiquiti Inc., New York, NY (US)

( * ) Notice: Subject to any disclaimer, the term of this patent is extended or adjusted under 35 U.S.C. 154(b) by 0 days.

(21) Appl. No.: 17/013,493

(22) Filed: Sep. 4, 2020

(65) Prior Publication Data

US 2020/0403306 A1 Dec. 24, 2020

Related U.S. Application Data

(63) Continuation of application No. 16/231,543, filed on Dec. 23, 2018, now Pat. No. 10,770,787, which is a (Continued)

(51) Int. Cl.
*H01Q 1/52* (2006.01)
*H01Q 1/24* (2006.01)

(Continued)

(52) U.S. Cl.
CPC ..... *H01Q 1/523* (2013.01); *H01Q 1/246* (2013.01); *H01Q 19/10* (2013.01); *H01Q 21/08* (2013.01); *H01Q 25/00* (2013.01)

(58) Field of Classification Search
CPC ..... H01Q 1/246; H01Q 1/523; H01Q 21/08
See application file for complete search history.

(56) References Cited

U.S. PATENT DOCUMENTS 3,851,221 A 11/1974 Beaulieu et al.
4,087,822 A 5/1978 Maybell et al.

(Continued)

FOREIGN PATENT DOCUMENTS

CN 1247641 A 3/2000
CN 1527439 A 9/2004

(Continued)

OTHER PUBLICATIONS

Schulz et al.; U.S. Appl. No. 16/933,956 entitled "Radio apparatuses for long-range communication of radio-frequency information," filed Jul. 20, 2020.

(Continued)

*Primary Examiner* — Andrea Lindgren Baltzell
*Assistant Examiner* — Amal Patel
(74) *Attorney, Agent, or Firm* — Shay Glenn LLP

(57) ABSTRACT

Multi-directional antenna assemblies including a plurality of individual antenna sections arranged in-line with a long axis, forming a linear assembly. An antenna assembly may include a radome over the linear assembly. A linear assembly may include three or more antenna sections, each with a trough-like reflector formed by two parallel walls, and may have corrugations at the outer edges to reduce noise. An array of radiators may be positioned at the base of each antenna section. The antenna sections may share a common vertical axis and each may have a beam axes that is offset by an angle. Adjacent antenna sections may be separated by an isolation plate with a corrugated outer edge. Each antenna section may radiate greater power in a specific direction as compared to the other antenna sections.

20 Claims, 21 Drawing Sheets

Related U.S. Application Data continuation of application No. 14/862,676, filed on Sep. 23, 2015, now Pat. No. 10,164,332.

(60) Provisional application No. 62/063,916, filed on Oct. 14, 2014.

(51) Int. Cl.

| | |
|---|---|
| ***H01Q 19/10*** | (2006.01) |
| ***H01Q 21/08*** | (2006.01) |
| ***H01Q 25/00*** | (2006.01) |

(56) References Cited

U.S. PATENT DOCUMENTS 4,557,225 A 12/1985 Sagues et al.
4,656,559 A 4/1987 Fathi
5,131,006 A 7/1992 Kamerman et al.
5,151,920 A 9/1992 Haagh et al.
5,295,154 A 3/1994 Meier et al.
5,381,314 A 1/1995 Rudy et al.
5,406,260 A 4/1995 Cummings et al.
5,422,887 A 6/1995 Diepstraten et al.
5,428,636 A 6/1995 Meier
5,504,746 A 4/1996 Meier
5,546,397 A 8/1996 Mahany
5,548,481 A 8/1996 Salisbury et al.
5,596,487 A 1/1997 Castaneda et al.
5,629,713 A 5/1997 Mailandt et al.
5,706,428 A 1/1998 Boer et al.
5,740,366 A 4/1998 Mahany et al.
5,828,339 A 10/1998 Patel
5,844,893 A 12/1998 Gollnick et al.
5,912,646 A 6/1999 Seki et al.
5,930,113 A 7/1999 McCann
5,936,542 A 8/1999 Kleinrock et al.
5,936,588 A 8/1999 Rao et al.
5,940,771 A 8/1999 Gollnick et al.
6,028,769 A 2/2000 Zurek
6,038,129 A 3/2000 Falaki et al.
6,084,772 A 7/2000 Pell et al.
6,130,892 A 10/2000 Short et al.
6,194,992 B1 2/2001 Short et al.
6,295,028 B1 9/2001 Jonsson et al.
6,337,990 B1 1/2002 Koshino
6,374,311 B1 4/2002 Mahany et al.
6,522,307 B2 2/2003 Kim
6,563,786 B1 5/2003 Nee
6,636,894 B1 10/2003 Short et al.
6,643,522 B1 11/2003 Young
6,665,536 B1 12/2003 Mahany
6,697,415 B1 2/2004 Mahany
6,714,559 B1 3/2004 Meier
6,788,250 B2 9/2004 Howell
6,789,110 B1 9/2004 Short et al.
6,795,852 B1 9/2004 Kleinrock et al.
6,810,426 B2 10/2004 Mysore et al.
6,813,260 B1 11/2004 Fogle
6,857,009 B1 2/2005 Ferreria et al.
6,868,399 B1 3/2005 Short et al.
7,020,082 B2 3/2006 Bhagavath et al.
7,038,620 B1 5/2006 Chubb et al.
7,040,383 B2 5/2006 Oyamada
7,079,079 B2 7/2006 Jo et al.
7,088,727 B1 8/2006 Short et al.
7,117,526 B1 10/2006 Short
7,136,286 B2 11/2006 Chuang
7,161,804 B2 1/2007 Oyamada
7,194,554 B1 3/2007 Short et al.
7,197,556 B1 3/2007 Short et al.
7,295,812 B2 11/2007 Haapoja et al.
7,382,329 B2 * 6/2008 Kim ..... H01Q 1/246 343/757
7,386,002 B2 6/2008 Meier
7,457,646 B2 11/2008 Mahany et al.
7,477,917 B2 1/2009 Rofougaran et al.
7,532,908 B2 5/2009 Rofougaran et al.
7,593,230 B2 9/2009 Abul-Haj et al.
7,633,757 B2 12/2009 Gustine et al.
7,643,794 B2 1/2010 Ofek et al.
D618,630 S 6/2010 Wei et al.
7,739,383 B1 6/2010 Short et al.
7,752,334 B2 7/2010 Paunikar et al.
7,764,504 B2 7/2010 Phillips et al.
D621,796 S 8/2010 Hu et al.
D622,230 S 8/2010 Yan et al.
7,826,426 B1 11/2010 Bharghavan et al.
7,889,701 B2 2/2011 Malik et al.
7,924,564 B1 4/2011 Wilson
8,077,113 B2 12/2011 Syed et al.
8,184,064 B2 5/2012 Sanford
8,190,708 B1 5/2012 Short et al.
8,335,272 B2 12/2012 Roberts
8,483,188 B2 7/2013 Walton et al.
8,498,574 B2 7/2013 Beninghaus et al.
8,604,989 B1 12/2013 Olsen
8,724,605 B2 5/2014 Zhang et al.
8,736,503 B2 5/2014 Zaghloul et al.
8,836,601 B2 9/2014 Sanford et al.
8,977,733 B1 3/2015 Phuong et al.
9,106,495 B2 8/2015 Kim et al.
9,293,817 B2 3/2016 Sanford
9,368,870 B2 6/2016 Dayanandan et al.
9,715,609 B1 7/2017 Fink et al.
9,761,954 B2 9/2017 Keniuk et al.
9,843,096 B2 12/2017 Sanford
9,912,053 B2 3/2018 Sanford et al.
10,069,580 B2 9/2018 Hardy et al.
10,084,238 B2 9/2018 Keniuk et al.
10,164,332 B2 12/2018 Pera et al.
10,284,268 B2 5/2019 Schulz et al.
10,680,342 B2 6/2020 Keniuk et al.
10,749,581 B2 8/2020 Schultz et al.
10,770,787 B2 9/2020 Para et al.
2002/0101388 A1 8/2002 Ippolito
2002/0126062 A1 9/2002 Matthews
2002/0138443 A1 9/2002 Schran et al.
2002/0193945 A1 12/2002 Tan et al.
2003/0052830 A1 3/2003 Ogawa et al.
2003/0128684 A1 7/2003 Hirsh et al.
2004/0027816 A1 2/2004 Ice
2004/0033817 A1 2/2004 Gorsuch et al.
2004/0203528 A1 10/2004 Ammar et al.
2005/0075070 A1 4/2005 Crilly
2005/0285803 A1 12/2005 Iacono et al.
2006/0020978 A1 1/2006 Miyagawa
2006/0114839 A1 6/2006 Meier et al.
2006/0203789 A1 9/2006 Iacono et al.
2006/0209876 A1 9/2006 Liu et al.
2006/0268760 A1 11/2006 Fang et al.
2007/0001918 A1 1/2007 Ebling et al.
2007/0058336 A1 3/2007 Cheng et al.
2007/0182657 A1 8/2007 Chiang et al.
2007/0280387 A1 12/2007 Li et al.
2007/0285327 A1 12/2007 Paschen et al.
2008/0225929 A1 9/2008 Proctor et al.
2009/0264148 A1 10/2009 Tom
2009/0286569 A1 11/2009 Rousu et al.
2009/0312044 A1 12/2009 Hottinen
2010/0014502 A1 1/2010 Singh et al.
2010/0060531 A1 3/2010 Rappaport
2010/0073260 A1 3/2010 Fujita
2010/0128758 A1 5/2010 Murakami et al.
2010/0238846 A1 9/2010 Xu et al.
2010/0271985 A1 10/2010 Gabriel et al.
2010/0283707 A1 * 11/2010 Foo ..... H01Q 5/42 343/872
2011/0063182 A1 3/2011 Sanford
2011/0064033 A1 3/2011 Gong et al.
2011/0116230 A1 5/2011 Kwak et al.
2012/0077504 A1 3/2012 Schadler et al.
2012/0106070 A1 5/2012 Landon
2012/0276949 A1 11/2012 Dorsey et al.
2013/0031201 A1 1/2013 Kagan et al.

(56) References Cited

U.S. PATENT DOCUMENTS

| | | | |
|---|---|---|---|
| 2013/0072243 | A1 | 3/2013 | Yu et al. |
| 2013/0072247 | A1 | 3/2013 | Park et al. |
| 2013/0099895 | A1 | 4/2013 | Harpak et al. |
| 2013/0115887 | A1 | 5/2013 | Kwon et al. |
| 2013/0272263 | A1 | 10/2013 | Pi et al. |
| 2013/0322495 | A1 | 12/2013 | Behdad et al. |
| 2014/0226698 | A1 | 8/2014 | Negus et al. |
| 2015/0188267 | A1 | 7/2015 | Choi et al. |
| 2015/0201429 | A1 | 7/2015 | Chen et al. |
| 2016/0105203 | A1 | 4/2016 | Rilling |
| 2016/0261030 | A1 | 9/2016 | Kim et al. |
| 2016/0261326 | A1 | 9/2016 | Barker et al. |
| 2018/0261916 | A1 | 9/2018 | Sanford et al. |
| 2019/0044248 | A1 | 2/2019 | Keniuk et al. |
| 2020/0259266 | A1 | 8/2020 | Keniuk et al. |

FOREIGN PATENT DOCUMENTS

| | | | | |
|---|---|---|---|---|
| CN | 101685907 | A | 3/2010 | |
| CN | 202103167 | U | 1/2012 | |
| CN | 102893173 | A | 1/2013 | |
| CN | 103812538 | A | 5/2014 | |
| CN | 203760677 | U | 8/2014 | |
| DE | 102012023938 | A1 * | 6/2014 | ..... H01Q 21/08 |
| DE | 102012023938 | A1 | 12/2014 | |
| EP | 0886336 | B1 | 10/2003 | |
| JP | 10-303808 | A | 11/1998 | |
| WO | WO98/40990 | A1 | 9/1998 | |
| WO | WO01/31855 | A2 | 5/2001 | |
| WO | WO01/31886 | A2 | 5/2001 | |
| WO | WO01/86877 | A2 | 11/2001 | |
| WO | WO2006/084331 | A1 | 8/2006 | |
| WO | WO2007/069809 | A1 | 6/2007 | |
| WO | WO2008/042804 | A2 | 4/2008 | |
| WO | WO2011/005710 | A2 | 1/2011 | |
| WO | WO2014/191756 | A1 | 12/2014 | |

OTHER PUBLICATIONS

Sanford et al.; U.S. Appl. No. 17/147,408 entitled "Array antennas having a plurality of directional beams," filed Jan. 12, 2021.

* cited by examiner

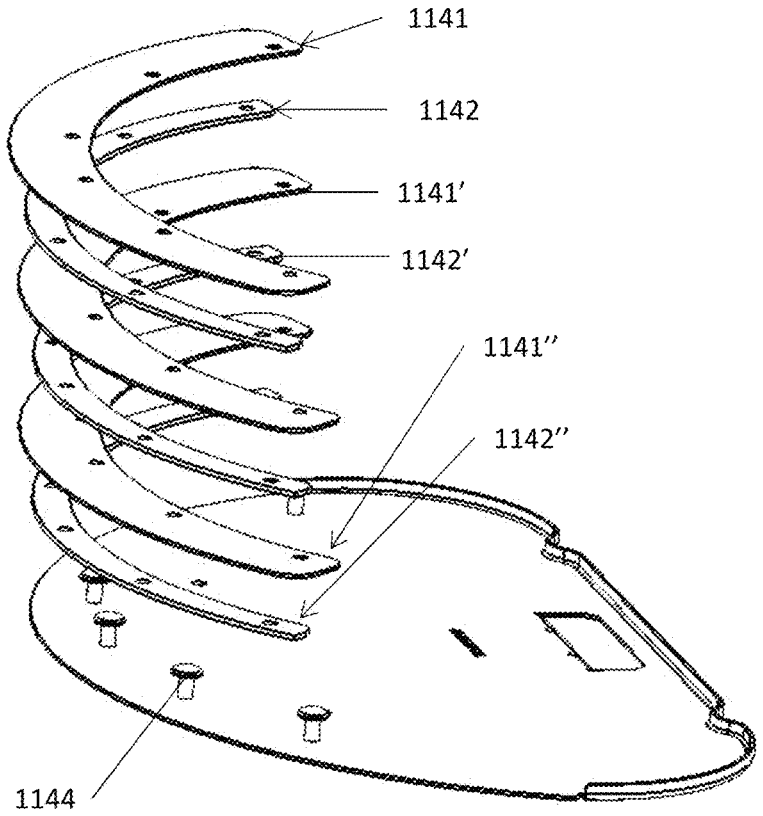
FIG. 11F
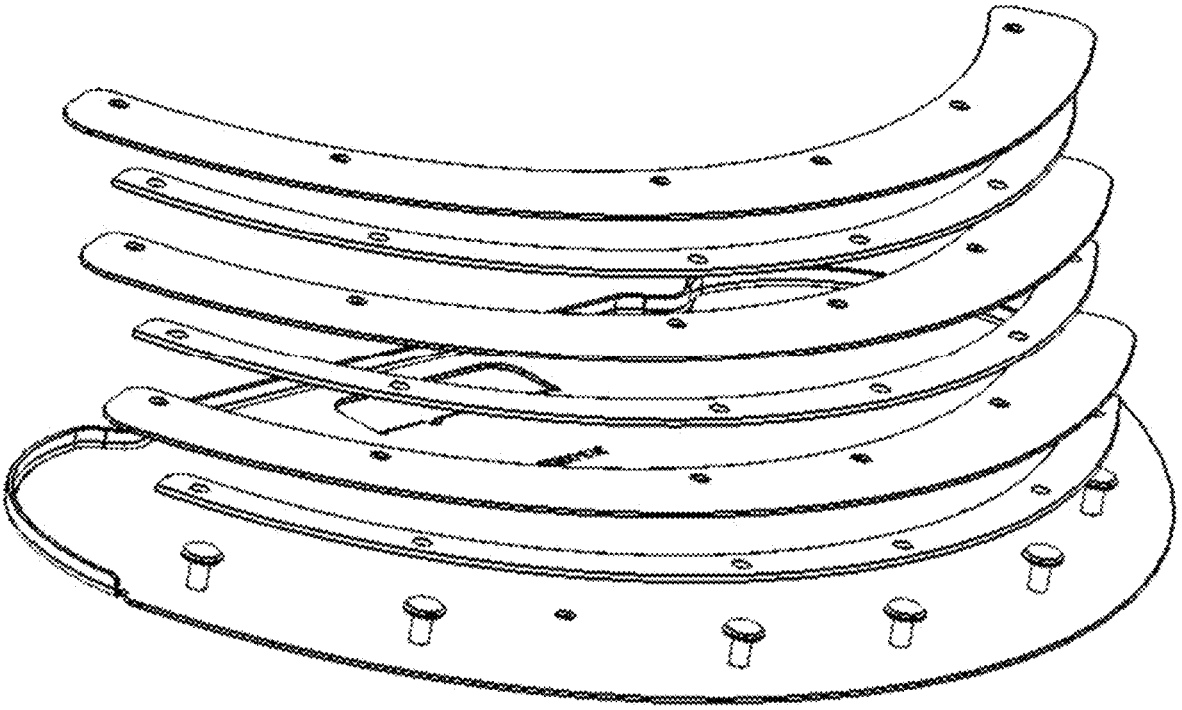
FJG. 11G

MULTI-SECTOR ANTENNAS

CROSS REFERENCE TO RELATED APPLICATIONS

This patent application is a continuation of U.S. patent application Ser. No. 16/231,543 filed Dec. 23, 2018, titled "MULTI-SECTOR ANTENNAS." which is a continuation of U.S. patent application Ser. No. 14/862,676 filed Sep. 23, 2015, titled "MULTI-SECTOR ANTENNAS." now U.S. Pat. No. 10,164,332, which claims priority to U.S. Provisional Patent Application No. 62/063,916, filed Oct. 14, 2014, titled "MULTI SECTOR ANTENNA." each of which is herein incorporated by reference in its entirety.

INCORPORATION BY REFERENCE

All publications and patent applications mentioned in this specification are herein incorporated by reference in their entirety to the same extent as if each individual publication or patent application was specifically and individually indicated to be incorporated by reference.

FIELD

The apparatuses (devices and systems) and methods of making and using them described herein relate antenna assemblies. In some variations, the antenna assemblies are configured for wireless radio and antenna devices that form part of a broadband wireless system for use as part of a system for accessing the internet. The wireless transmission stations described herein may be configured for indoor, outdoor, or indoor and outdoor use.

BACKGROUND

Wireless fidelity, referred to as "WiFi" generally describes a wireless communications technique or network that adheres to the specifications developed by the Institute of Electrical and Electronic Engineers (IEEE) for wireless local area networks (LAN). A WiFi device is considered operable with other certified devices using the 802.11 specification of the IEEE. These devices allow wireless communications interfaces between computers and peripheral devices to create a wireless network for facilitating data transfer. This often also includes a connection to a local area network (LAN).

Operating frequencies range within the WiFi family, and typically operate around the 2.4 GHz band and 5 GHz band of the spectrum. Multiple protocols exist at these frequencies and these may also differ by transmit bandwidth.

Laptops and similar wireless devices are generally the weakest link in a WiFi system, because the typically have a low transmission (TX) power between the transmitters and the access points (APs). Thus high gain antenna systems would be useful. Antenna gain provides for directional capabilities of the radiation pattern, which may be helpful in some applications such as extended distances and high WiFi density areas. A multi-directional antennae may be particularly useful in point to multi-point communication arrangement, where a centrally located high-gain antenna may be configured to service multiple Client Premise Equipment (CPE) devices. To date, obstacles for designing multi-directional antennae typically include achieving high gain, low cost and manufacturability, since multi-directional antennae tends to be more complicated in design than less directional antennas. Furthermore, antennae configured for outdoor deployment tend to further increase design complexity and cost due to weather and other environmental factors.

It would be beneficial to provide low-profile antenna systems for wireless signal transmission that are easy to manufacture and operate, particularly antennas configured to provide broadband data transmissions coverage in multiple sectors of regions that are each serviced by a dedicated radio transceiver of the multi-sector antenna. Such apparatuses may be particularly useful for radio transmissions operating above 1 GHz for data and voice communications. Described herein are antenna systems that may address the issues and needs discussed above.

SUMMARY OF THE DISCLOSURE

Described herein are multi-directional antenna assemblies that include a plurality (e.g., 2, 3, 4, 5 or more, typically 3 or more) of antenna sections that are arranged in in-line along a long axis, for example, vertically stacked atop one another. Each antenna section may be formed to provide a relatively narrow beamwidth in a specific beam axis that is distinct from other antenna sections in the antenna assembly. The antenna assembly may include a radome cover positioned over the linear assembly. In one variation, the linear assembly includes three antenna sections. Although the description provided herein illustrates antenna assemblies having three stacked antenna sections, it should be understood that antenna assemblies as described herein may include only two antenna sections or more than three (e.g., 4, 5, 6, 7, 8, 9, etc.) antenna sections.

In general, the antenna sections of an antenna assembly as described herein are placed adjacent to each other in a line (e.g., in an axis) may be referred to as stacked, though they may be oriented horizontally, vertically, or any other angle. The different antenna sections forming the antenna assembly may be structurally identical or similar, or they may be different.

For example, all of the antenna sections forming an antenna assembly may be shaped generally as an elongate trough, having a long open region that is formed by two walls connecting to a base. The walls may flare outward to form the opening, so that the opening is larger than the base (which is typical opposite the base). The walls may extend along the long axis of the antenna assembly. In some variations the opening (e.g., the end regions of the walls facing away from the base) may include a choke region that is formed of ridges (e.g., "corrugations") that extend along the opening. e.g., parallel to the long axis of the antenna assembly. The corrugations may include a plurality of ridges (e.g., between 2 and 100, e.g. between about 2 and 50, between about 2 and 30, between about 2 and 25, etc.). The ridges may be spaced apart from each other by a predetermine amount, and may be formed by bending, crimping, or otherwise manipulating the same material forming the walls (e.g., a metal such as aluminum), or they may be added to the wall and attached thereto. In general, the choke/corrugations are positioned at the open edge of each wall.

Thus, each antenna section may be (e.g., vertically) separated from adjacent antenna sections by one or more isolation plates (walls) interposed abutting the adjacent antenna sections. In general, an isolation plate also including corrugations along an outwardly facing edge may be positioned between each of the antenna sections forming the antenna assembly. These isolation plates may have an outer edge that extends beyond the opening (trough opening) formed by the walls, and a plurality of ridges extending parallel to each other and the outer edge may form the corrugations. For any of the corrugation (choke) regions described herein, the ridges may be oriented outward, e.g., facing the direction of transmission of the antenna section. Any of the corrugations described herein may have a depth and/or spacing between the corrugations of, e.g., ¼ of the average, median, and/or mean of the wavelengths transmitted to/from the antenna section(s). An example of corrugations and choke regions may be found, for example, in U.S. patent application Ser. No. 14/486,992, filed Sep. 15, 2014 (and published as US-2015-0002357), titled "DUAL RECEIVER/TRANSMITTER RADIO DEVICES WITH CHOKE".

Each of the antenna sections may also include an array of radiators positioned at or on the base within the trough. The array of radiators may be an array (e.g., a linear array) of radiating elements that are used to emit and/or receive electromagnetic energy for transmission of RF signals. The array of radiators may be arranged in a line (e.g., parallel to the long axis of the antenna assembly). The radiators may preferably be disc-shaped (or funnel-shaped) radiators, as described herein. Each antenna array is configured to emit electromagnetic (e.g., RF) energy from the antenna section so that antenna section has a distinct main lobe and a beam axis. In general, for a particular antenna assembly, the antenna sections forming the antenna assembly share a common (long) axis, which may be a vertical axis. The beam axes of the antenna sections may be oriented in the antenna assembly such that they originate from the common vertical axis, and the beam axes may be non-overlapping and each beam axes may point towards a different direction. For example, each beam axis may be separated from the other beam axes of the antenna assembly by a particular angular offset (e.g., 10 degrees, 15 degrees, 20 degrees, 25 degrees, 30 degrees, 35 degrees, 40 degrees, 50 degrees, 60 degrees, etc.).

In general, an antenna assembly may be configured to form an effective combined beamwidth that provides wide range of coverage across multiple sectors of areas.

For example, described herein are antenna assembly having a first axis, the antenna assembly comprising: a plurality of antenna sections arranged adjacent to each other along the first axis, wherein each antenna section includes: an elongate trough extending in the first axis, wherein the elongate trough comprises a first wall, a second wall, and a base extending between the first wall and the second wall, an opening into the trough between the first wall and the second wall, wherein the opening has a width that is larger than a width at the base, a radiator array, positioned at the base, a corrugation on the first wall along an edge of the first wall opposite the base, and a corrugation on the second wall along an edge of the second wall opposite the base.

An antenna assembly may include a long axis (e.g., a first axis), and: a first antenna section that is linearly between a second antenna section and a third antenna section, wherein the first, second and third antenna sections are in the first axis, further wherein each of the first, second and third antenna sections include: an elongate trough extending in the first axis, wherein the elongate trough comprises a first wall, a second wall, and a base extending between the first wall and the second wall, an opening into the trough between the first wall and the second wall, wherein the opening has a width that is larger than a width at the base, a radiator array comprises an array of radiator elements arranged in a line at the base along in the first axis, a corrugation on the first wall along an edge of the first wall opposite the base comprising a plurality of ridges extending in the first axis, and a corrugation on the second wall along an edge of the second wall opposite the base comprising a plurality of ridges extending in the first axis.

The corrugation on the first wall and the corrugation on the second wall of each antenna section of the plurality of antenna sections may each comprise a plurality of ridges extending in the first axis. In general, these corrugations may also be referred to as isolation choke regions (e.g., isolation choke boundaries).

Any of these antenna assemblies may include one or more isolation plates (referred to also herein as isolation plates) between adjacent antenna sections. The isolation walls may also include an isolation choke boundary (e.g., corrugations) along an outer edge facing the opening. The isolation walls may be formed of the same material as the walls, and may form the "top" and/or "bottom" of the trough.

In general, the radiator array may include a plurality of radiator elements (e.g., disk elements). The radiator elements may be arranged in a line, e.g., along in the first axis.

The output beamwidth of each antenna section may typically correspond to the angle between the first and second walls. In general, the beamwidth of each section may be e.g., 10 degrees, 15 degrees, 20 degrees, 25 degrees, 30 degrees 0.35 degrees, 40 degrees, 45 degrees, 50 degrees, 55 degrees, 60 degrees, 65 degrees, 70 degrees, 75 degrees, 80 degrees, 85 degrees, 90 degrees, etc. For example, the beamwidth for each antenna section may be may be 30 degrees. In some variations the beamwidth for each antenna section is 60 degrees. The antenna sections an antenna assembly may have identical output beamwidths, or they may have different beamwidths. The antenna assemblies described herein (which may be referred to alternatively as in-line, stacked, or linear antenna assemblies) may typically have a combined beamwidth of all the antenna sections that is, e.g., between about 45 degrees and 360 degrees (e.g., between about 60 degrees and 180 degrees, e.g., between about 60 degrees and 120 degrees, etc.). For example, the combined beamwidth may be 90 degrees. In general, the combined bandwidth includes overlap of the bandwidths between the antenna sections, but extends from one edge to the other of the overlapping beamwidths.

In general, each antenna section of the antenna assembly has a beam axis, and each beam axis for the different antenna sections may point in different directions. For example, a beam axis of a first antenna section may be radially separated by, e.g., 30 degrees from a beam axis of a second antenna, and may also be radially separated by, e.g., 60 degrees from a beam axis of third antenna section in the plurality of antenna sections. Thus, each beam axis for the different antenna sections may be separated from the next nearest beam axis by a predetermined amount, which may be the same (e.g., 10 degrees, 15 degrees, 20 degrees, 25 degrees, 30 degrees, etc.) or different. In general the "first" "second" and "third" (and more) antenna sections described herein may be positioned in any order in the long axis. For example, a first antenna section may be positioned between (e.g., immediately next two) a second and a third antenna section, or a third antenna section may be adjacently (e.g., immediately next to) positioned between a first and a second antenna section, etc.

For example, in variations in which the same, or approximately the same radiator elements are arranged on the bases of each antenna section, the base of each antenna section may be shifted (e.g., rotated about the long axis of the antenna assembly). For example, a first antenna section (e.g., base) in the plurality of antenna sections may be rotated 30 degrees relative to the second antenna section (e.g., base) in the plurality of antenna sections, and rotated 60 degrees relative to a third antenna section (e.g., base) in the plurality of antenna sections, etc. The degree of rotation between each antenna section (and particularly between the different bases) may be constant or variable. In some variations the degree of rotation between the different antenna sections may be adjustable. Also, as mentioned above, the antenna sections may have varying output beamwidths. In some variations, at least two of the antenna sections have identical beamwidths.

Also described herein are methods of operating any of the antenna assemblies described herein as a multi-sector antenna. For example, described herein are methods for operating an antenna assembly having a plurality of antenna sections that are linearly positioned adjacent to each other in a first axis, wherein each antenna section comprises a first wall, a second wall, and a base extending between the first wall and the second wall, having an opening between the first wall and the second wall and an array of radiator elements on the base, and wherein the opening has a width that is larger than a width at the base, wherein each antenna section has a unique beam axis directed at a different direction. Such a method may include: emitting electromagnetic waves from the array of radiator elements within each antenna section, further wherein an output beamwidth of each antenna section corresponds to an angle between the first wall and the second wall of the antenna section; and further wherein electromagnetic waves emitted from each of the plurality of antenna sections only partially overlap with electromagnetic waves emitted from adjacent antenna sections.

A method of operating an antenna assembly may include, for example: positioning an antenna assembly comprising three or more antenna sections arranged atop each other along a first vertical axis so that each antenna assembly is positioned in a different direction orthogonal to the first vertical axis; emitting electromagnetic waves from an array of radiator elements within each antenna section, wherein an output beam angle of each antenna is angularly offset from the output beam angle of every other antenna section; and reducing transmission of electromagnetic waves between antenna sections using isolation plates positioned between adjacent antenna sections, wherein each isolation plate has an outer edge and a plurality of ridges extending parallel to the outer edge forming a corrugated pattern along a portion of the outer edge.

Emitting may comprise emitting electromagnetic waves from all of the antenna sections so that the combined beamwidth is between about 60 degrees and 360 degrees (e.g., approximately 90 degrees). Emitting may also or alternatively comprise emitting electromagnetic energy from a first antenna section in the plurality of antenna sections with a first beam axis that is radially separated by 30 degrees from a second beam axis of a second antenna section in the plurality of antenna sections, and 60 degrees from a third beam axis of third antenna section in the plurality of antenna sections. In some variations, emitting electromagnetic waves from the array of radiator elements within each antenna section comprises independently emitting electromagnetic waves from each of the antenna sections; alternatively emission from all or some of the antenna sections may be coordinated and/or identical.

In general, emitting electromagnetic waves from the array of radiator elements within each antenna section comprises emitting electromagnetic waves from a linear array of the radiator elements arranged in line with the first axis.

Also described herein are methods of operating an antenna assembly having a plurality of antenna sections that are linearly positioned adjacent to each other in a first axis, the method comprising: emitting a first radio wave signal in a first direction from a first array of radiators in the first axis and in a first one of the plurality of antenna sections; emitting a second radio wave signal in a second direction from a second array of radiators in the first axis and in a second one of the plurality of antenna sections; emitting a third radio wave signal in a third direction from a third array of radiators in the first axis and in a third one of the plurality of antenna sections; suppressing radio wave signals between the plurality of antenna sections to prevent radio wave signals from any of the antenna sections of the plurality of sections from being received by adjacent antenna sections.

The regions covered by the first, second and third radio waves may be substantially non-overlapping. For example, the first, second and third directions may be angularly directed in different direction corresponding to each pair of the walls and are non-overlapping.

Any of these methods may also include limiting the spread of each of the first, second and third radio wave signals by, for each of the first, second and third array of radiators, providing a pair of walls angularly positioned adjacent to the array of radiators, wherein the front edge of each of the walls includes vertical corrugations for isolating radio wave signals.

The step of suppressing radio wave signals may comprises providing an isolation plate between adjacent antenna sections of the plurality of antenna sections, wherein a front edge of the isolation plate includes corrugations.

For example, described herein are antenna assemblies having a first vertical axis, that include: three or more antenna sections arranged atop each other along the first vertical axis, wherein each antenna section includes: a reflector, and a radiator array, positioned at a base of the reflector, wherein each antenna section is separated from an adjacent antenna section by an isolation plate having an outer edge, further comprising a plurality of ridges extending parallel to the outer edge forming a corrugation along a portion of the outer edge, further wherein each antenna section is oriented along the first vertical axis so that an output beam axis of each antenna section points in a different direction than any other antenna section in the antenna assembly. Each antenna section may be oriented along the first vertical axis so that the output beam axis of each antenna section points in a different direction that is offset by more than about 10 degrees from any other output beam axis of any antenna section in the antenna sections. For each antenna section, the reflector may comprise two walls positioned perpendicular to the isolation plate, and the corrugation may extend along the outer edge between the walls of the reflector. The radiator array may comprise a line of circular disks (dish or funnel-shaped radiators/absorbers).

Each antenna section may comprise an elongate trough extending in the first vertical axis formed by a first wall and a second wall. Each antenna section may comprise an elongate trough extending in the first vertical axis formed by a first wall and a second wall and a base between the first wall and second wall, and an opening into the trough between the first wall and the second wall, wherein the opening has a width that is larger than a width at the base.

The base of a first antenna section may be fixed at an angle that is rotated 30 degrees relative to the base of a second antenna section, and is at an angle rotated 60 degrees relative to the base of a third antenna section. The antenna assembly may also include a corrugation on the first wall along an edge of the first wall opposite the base, and a corrugation on the second wall along an edge of the second wall opposite the base. The corrugation on the first wall and the corrugation on the second wall of each antenna section of the antenna sections may each comprise a plurality of ridges extending in the first axis.

Also described herein are antenna assemblies having a first axis, the antenna assembly comprising: a first antenna section that is linearly between a second antenna section and a third antenna section, wherein the first, second and third antenna sections are in the first axis, further wherein each of the first, second and third antenna sections include: an elongate trough extending in the first axis, wherein the elongate trough comprises a first wall, a second wall, and a base extending between the first wall and the second wall, an opening into the trough between the first wall and the second wall, wherein the opening has a width that is larger than a width at the base, a radiator array comprises an array of disc-shaped radiator elements arranged in a line at the base along in the first axis, a corrugation on the first wall along an edge of the first wall opposite the base comprising a plurality of ridges extending in the first axis, and a corrugation on the second wall along an edge of the second wall opposite the base comprising a plurality of ridges extending in the first axis; and a first isolation plate between the first and second antenna section, and a second isolation plate between the second and third antenna sections, wherein the first and second isolation plates each comprise a plurality of ridges extending parallel to an outer edge and forming a corrugation along the outer edge.

BRIEF DESCRIPTION OF THE DRAWINGS

FIG. 1A is a front view, FIG. 1B is a back view. FIG. 1C is a left view. FIG. 1D is a right view, FIG. 1E is a top view, FIG. 1F is a bottom view, and FIG. 1G is an isometric view.

FIGS. 2A-2D show front perspective, front, top perspective and side perspective views, respectively. FIGS. 2E-2H show front, back, right side and left side views, respectively. FIGS. 2I and 2J show top and bottom views, respectively, and FIG. 2K is a perspective view of the back of the multi-sector antenna assembly.

In FIG. 10A, portions of the rest of the multi-sector antenna have been removed for clarity.

FIGS. 11A-11G illustrate one variation of an isolation plate including a corrugated outer edge region. FIG. 11A is a perspective view, FIG. 11B is a top view, FIG. 11C is a bottom view. FIG. 11D is a side view, and FIG. 11E is a front view. FIGS. 11F and 11G show exploded perspective views.

DETAILED DESCRIPTION

Figure 1A:
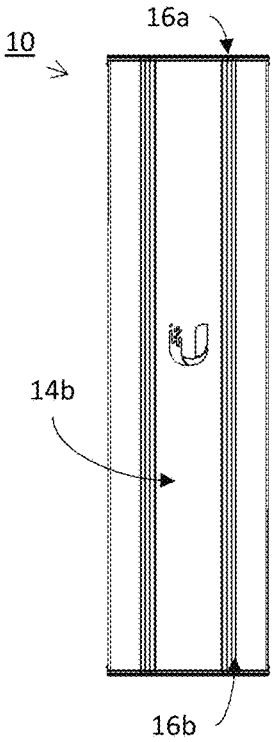
FIGS. 1A-1G illustrate one variation of a multi sector assembly, including a mounting bracket for optional pole mounting.

Described herein are multi-sector antenna assemblies. These assemblies are arranged typically arranged as a unitary frame having a plurality (e.g., 2, 3, 4, 5, 6, 7, 8, or more) internal antenna sections that are arranged in a line, with each antenna section adjacent to another antenna section along a first axis. The antenna sections typically each have a characteristic bandwidth and beam-angle; the beam-angles may extend out from the first axis and the beam-angle of each antenna section may be directed in a different direction from the beam-angles of the other antenna sections. The entire antenna assembly may be covered in a complete or partial housing, which may include, for example, a radome. In general, these multi-sector antenna assemblies may be arranged so that the antenna sections are stacked atop each other (e.g., when the antenna assembly is oriented in a vertical position).

For example, a multi-sector antenna assembly may include a plurality of antenna sections that are arranged adjacent to each other along a first axis. Each antenna section may be shaped as an elongate trough that extends in the first axis, and typically includes a first (e.g., right) wall, a second (e.g., left) wall, and a base extending between the first wall and the second wall, forming three sides of a section (e.g., transverse to the first axis) through the trough; the perimeter of this section may be approximately trapezoidal, so that the opening into the trough between the first wall and the second wall opposite from the base (forming the back wall) may has a width that is larger than a width at the base. Each antenna section may also include a radiator array positioned at the base (e.g., on the base, extending from the base, etc.). Any of these antenna sections may also include choke boundary region along at least two of the edges (e.g., the edges of the first and second walls opposite from the base). This choke boundary region may be referred to as a corrugation or corrugation region. For example, each antenna section may include a corrugation on the first wall along an edge of the first and second wall opposite the base. The corrugation may limit the passage of electromagnetic energy between the antenna section and another antenna (e.g., antenna assembly or any other antenna) nearby, helping to isolate the antenna section.

Each of these features, as well as additional features, including variations of these and additional features, are described and illustrated in greater detail below. Specific examples of components and arrangements are intended for purposes of illustration only and are not intended to limit the scope of the present invention. Regarding the figures, the present disclosure may repeat reference numerals and/or letters in the various examples. This repetition is for the purpose of simplicity and clarity and does not in itself dictate a relationship between the various embodiments and/or configurations discussed. References to specific techniques include alternative, further, and more general techniques, especially when describing aspects of this application, or how inventions that might be claimable subject matter might be made or used. References to contemplated causes or effects. e.g., for some described techniques, do not preclude alternative, further, or more general causes or effects that might occur in alternative, further, or more general described techniques. References to one or more reasons for using particular techniques, or for avoiding particular techniques, do not preclude other reasons or techniques, even if completely contrary, where circumstances might indicate that the stated reasons or techniques might not be as applicable as the described circumstance.

The terms "antenna", "antenna system" and the like, may generally refer to any device that is a transducer designed to transmit or receive electromagnetic radiation. In other words, antennas convert electromagnetic radiation into electrical currents and vice versa. Often an antenna is an arrangement of conductor(s) that generate a radiating electromagnetic field in response to an applied alternating voltage and the associated alternating electric current, or can be placed in an electromagnetic field so that the field will induce an alternating current in the antenna and a voltage between its terminals.

The phrase "wireless communication system" generally refers to a coupling of EMF's (electromagnetic fields) between a sender and a receiver. For example, and without limitation, many wireless communication systems operate with senders and receivers using modulation onto carrier frequencies of between about 2.4 GHz and about 5 GHz. However, in the context of the invention, there is no particular reason why there should be any such limitation. For example and without limitation, wireless communication systems might operate, at least in part, with vastly distinct EMF frequencies, e.g., ELF (extremely low frequencies).

The phrase "access point", the term "AP", and the like, generally refers to any devices capable of operation within a wireless communication system, in which at least some of their communication is potentially with wireless stations. For example, an "AP" might refer to a device capable of wireless communication with wireless stations, capable of wire-line or wireless communication with other AP's, and capable of wire-line or wireless communication with a control unit. Additionally, some examples AP's might communicate with devices external to the wireless communication system (e.g., an extranet, internet, or intranet), using an L2/L3 network. However, in the context of the invention, there is no particular reason why there should be any such limitation. For example one or more AP's might communicate wirelessly, while zero or more AP's might optionally communicate using a wire-line communication link.

The term "filter", and the like, generally refers to signal manipulation techniques, whether analog, digital, or otherwise, in which intervals of frequencies may be selectively transmitted or rejected. The transmitted intervals are called passbands and the rejected intervals are called stopbands.

By way of example, in systems in which frequencies both in the approximately 2.4 GHz range and the approximately 5 GHz range are concurrently used, it might occur that a single band-pass, high-pass, or low-pass filter for the approximately 2.4 GHz range is sufficient to distinguish the approximately 2.4 GHz range from the approximately 5 GHz range, but that such a single band-pass, high-pass, or low-pass filter has drawbacks in distinguishing each particular channel within the approximately 2.4 GHz range or has drawbacks in distinguishing each particular channel within the approximately 5 GHz range. In such cases, a 1st set of signal filters might be used to distinguish those channels collectively within the approximately 2.4 GHz range from those channels collectively within the approximately 5 GHz range. A 2nd set of signal filters might be used to separately distinguish individual channels within the approximately 2.4 GHz range, while a 3rd set of signal filters might be used to separately distinguish individual channels within the approximately 5 GHz range.

The phrase "isolation technique", the term "isolate", and the like, may refer to any device or technique involving reducing the amount of undesirable, non-specific, non-targeted and/or unintended signals (noise) perceived on a device, e.g., a 1st channel of a device, when signals are concurrently communicated on a 2nd channel. This is sometimes referred to herein as "crosstalk" "interference", or "noise".

The phrase "null region", the term "null", and the like, generally refer to regions in which an operating antenna (or antenna part) has relatively little EMF effect on those particular regions. This has the effect that EMF radiation emitted or received within those regions are often relatively unaffected by EMF radiation emitted or received within other regions of the operating antenna (or antenna part).

The term "radio", and the like, generally refers to (1) devices capable of wireless communication while concurrently using multiple antennae, frequencies, or some other combination or conjunction of techniques, or (2) techniques involving wireless communication while concurrently using multiple antennae, frequencies, or some other combination or conjunction of techniques.

The terms "polarization", "orthogonal", and the like, generally refer to signals having a selected polarization, e.g., horizontal polarization, vertical polarization, right circular polarization, left circular polarization. The term "orthogonal" generally refers to relative lack of interaction between a 1st signal and a 2nd signal, in cases in which that 1st signal and 2nd signal are polarized. For example and without limitation, a 1st EMF signal having horizontal polarization should have relatively little interaction with a 2nd EMF signal having vertical polarization.

The term "lobes" refers to the radiation pattern of an antenna. An antenna shows a pattern of "lobes" at various angles, directions where the radiated signal strength reach a maximum, separated by "nulls", angles at which the radiation falls to zero. The lobe that is designed to be bigger than the others is the "main lobe". The other lobes are "sidelobes". The "sidelobe" in the opposite direction from the "main lobe" is called the "backlobe".

The term "beamwidth" may refer to the half power beamwidth, which is the angle between the half-power (−3 dB) points of the main lobe of an antenna (or, as described herein, a portion of an antenna comprising a subset of emitters) when referenced to the peak effective radiated power of the main lobe. Beamwidth is usually, but not always, expressed in degrees, and for the horizontal plane. As described herein, a multi-sector antenna as described herein may include a plurality of antenna sections, each having an individual (and independent and/or overlapping) beamwidth. The beamwidth for these antennas may reference the "horizontal plane" (e.g., a plane that is perpendicular to the axis formed by, in some variations, the emitting elements).

The term "beam axis" of an antenna typically references the main lobe of the radiation pattern of such antenna. The beam axis may be the axis of maximum radiation that passes through the main lobe.

The phrase "wireless station" (WS), "mobile station" (MS), and the like, generally refer to devices capable of operation within a wireless communication system, in which at least some of their communication potentially uses wireless techniques.

The phrase "patch antenna" or "microstrip antenna" generally refers to an antenna formed by suspending one or more metal patches over a ground plane. The assembly may be contained inside a plastic radome, which protects the antenna structure from damage. A patch antenna may be constructed on a dielectric substrate to provide for electrical isolation.

The phrase "dual polarized" generally refers to antennas or systems formed to radiate electromagnetic radiation polarized in two modes. Generally the two modes are horizontal radiation and vertical radiation.

Figure 1B:
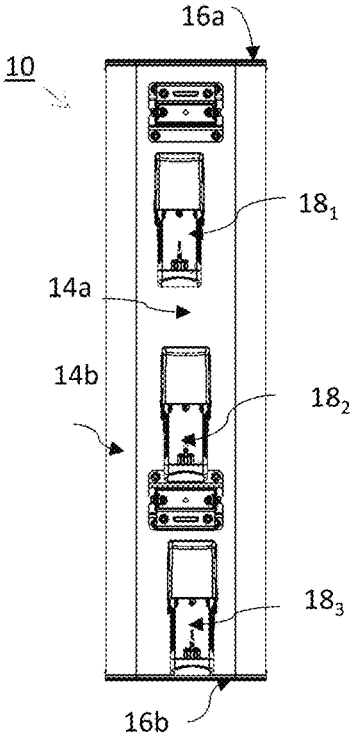
Figure 1C:
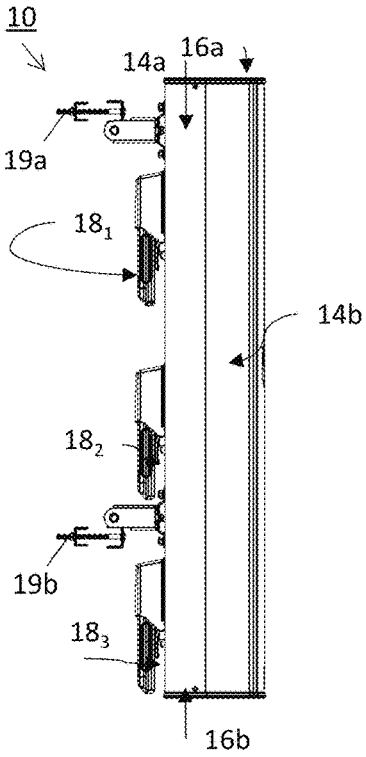
Figure 1D:
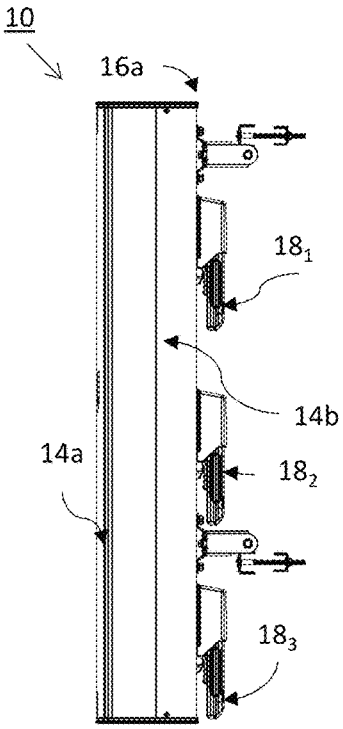
Figure 1E:
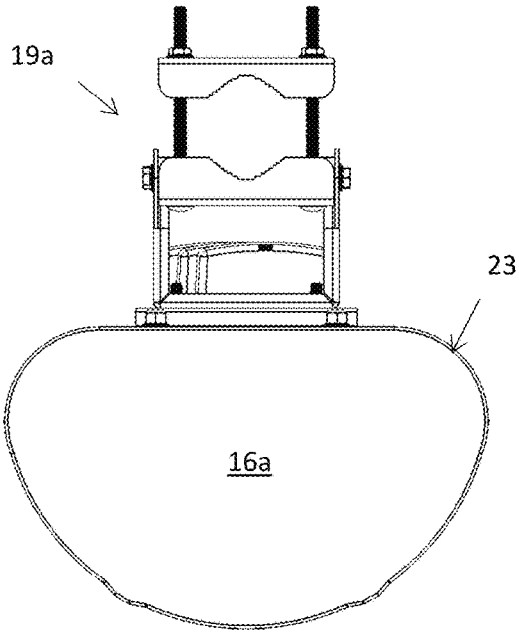
Figure 1F:
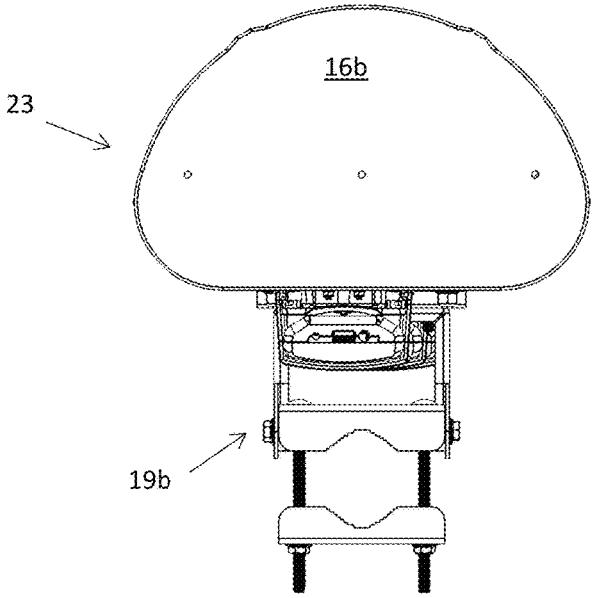
Figure 1G:
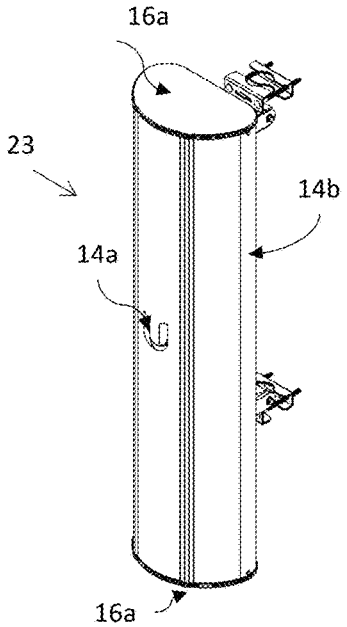

For example, FIGS. 1A-1G illustrates one variation of a multi-sector antenna assembly 10 shown from different angles. FIG. 1A illustrates a front view, FIG. 1B illustrates a rear view, FIG. 1C illustrates a left side-view, FIG. 1D illustrates a right side-view. FIG. 1E illustrates a top view, FIG. 1F illustrates a bottom view, and FIG. 1G illustrates an isometric view. In this example, the linear antenna assembly 12 is partially covered by a radome assembly that includes cover 14*a* and back panel 14*b*. The endcaps 16*a*, 16*b*, cover the ends of the linear antenna assembly 12 and radome assembly. This combination forms a weather resistant housing 23 covering the entire antenna assembly, including the component individual antenna sections arranged in a line of the long axis of the antenna assembly.

In the example of a linear antenna assembly 12 shown in FIGS. 1A-1G, the antenna assembly includes three antenna sections (not visible within the antenna assembly outer housing). Exemplary antenna sections are illustrated in FIGS. 2A-2D. As shown in FIGS. 1A-1G, a radio transmitter $\mathbf{18}_1$, $\mathbf{18}_2$, $\mathbf{18}_3$ may be connected to each antenna section. The endcaps 16*a*, 16*b*, and radome assembly of the outer housing may be made of insulating material. e.g. plastic. In one variation, the radome assembly housing 14 has a length of 1.5 m and a base width of 315 mm. Any appropriate mounting (e.g., mounting bracket 19*a*, 19*b*) may be included as part of the outer housing 23, or added to the outer housing to support the antenna assembly, e.g., when mounting to a pole, post, wall, or the like.

Figure 2A:
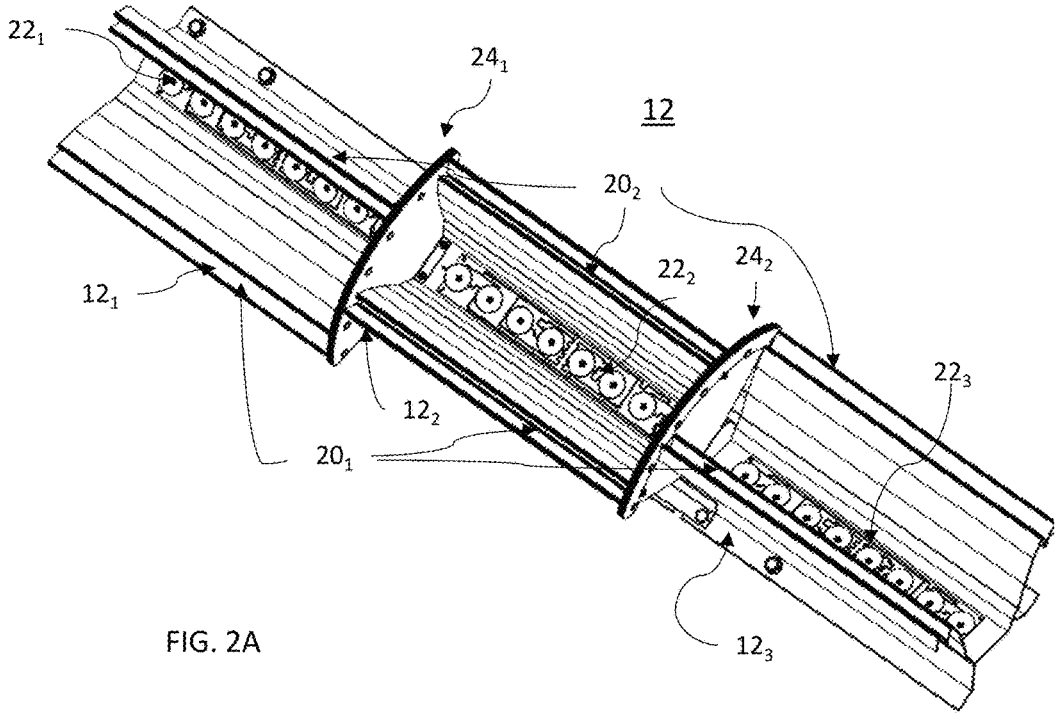
FIGS. 2A-2K illustrates an example of a multi-sector antenna assembly comprising a linear arrangement of sector antenna, similar to that shown in FIGS. 1A-1G, without a radome covering the antenna elements.
Figure 2B:
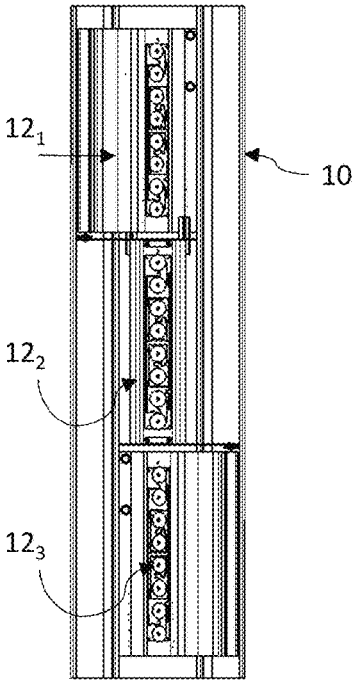
Figure 2C:
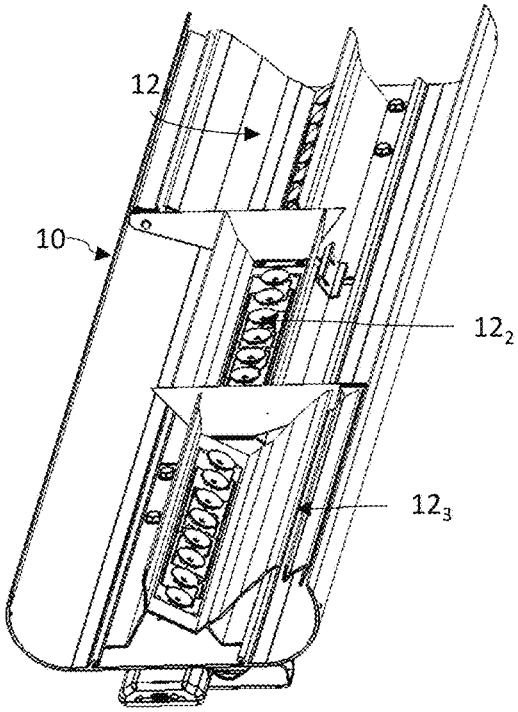
Figure 2D:
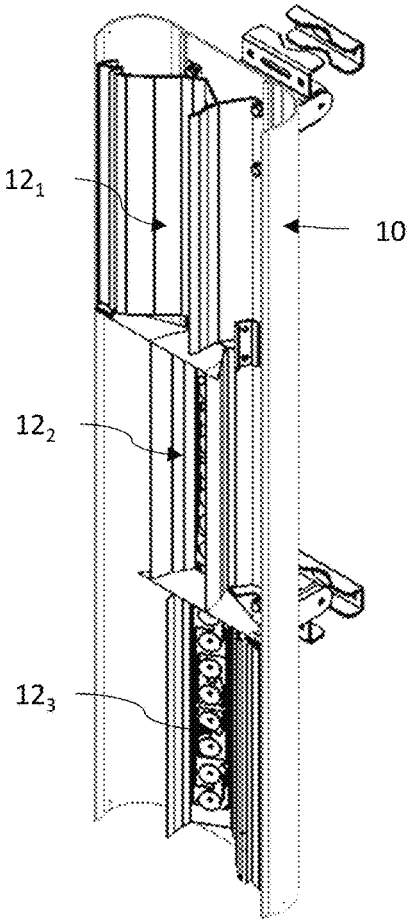
Figure 2E:
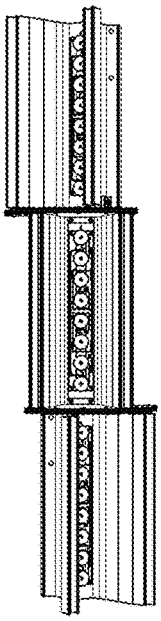
Figure 2F:
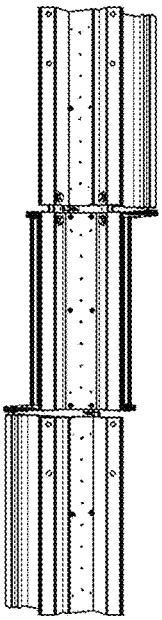
Figure 2G:
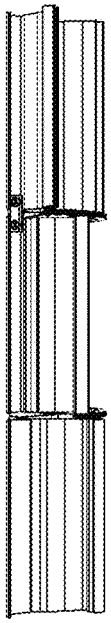
Figure 2H:
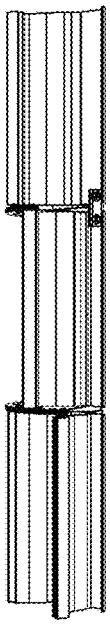
Figure 2I:
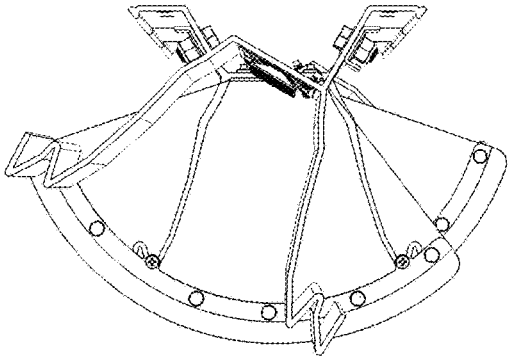
Figure 2J:
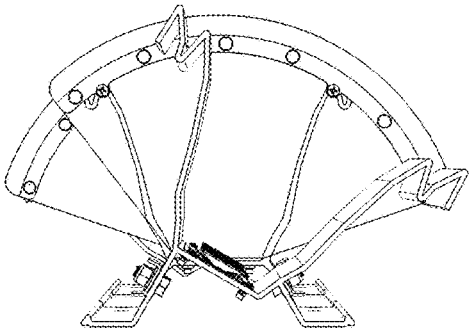
Figure 2K:
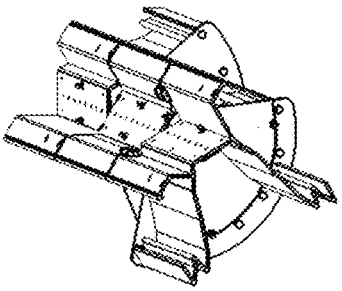

FIG. 2A shows the linear assembly 12 of FIGS. 1A-1G without a radome cover 14*a* and the back panel 14*b*. For example, FIGS. 2A-2D illustrate perspective views of the linear assembly 12. As shown, the linear assembly 12 is attached to a back panel 14*b*. FIG. 2E illustrates a front view. FIG. 2F illustrates a rear view. FIG. 2G illustrates a left side-view. FIG. 2H illustrates a right side-view. FIG. 2I illustrates a top view. FIG. 2J illustrates a bottom view. FIG. 2K illustrates a perspective view.

Figure 3A:
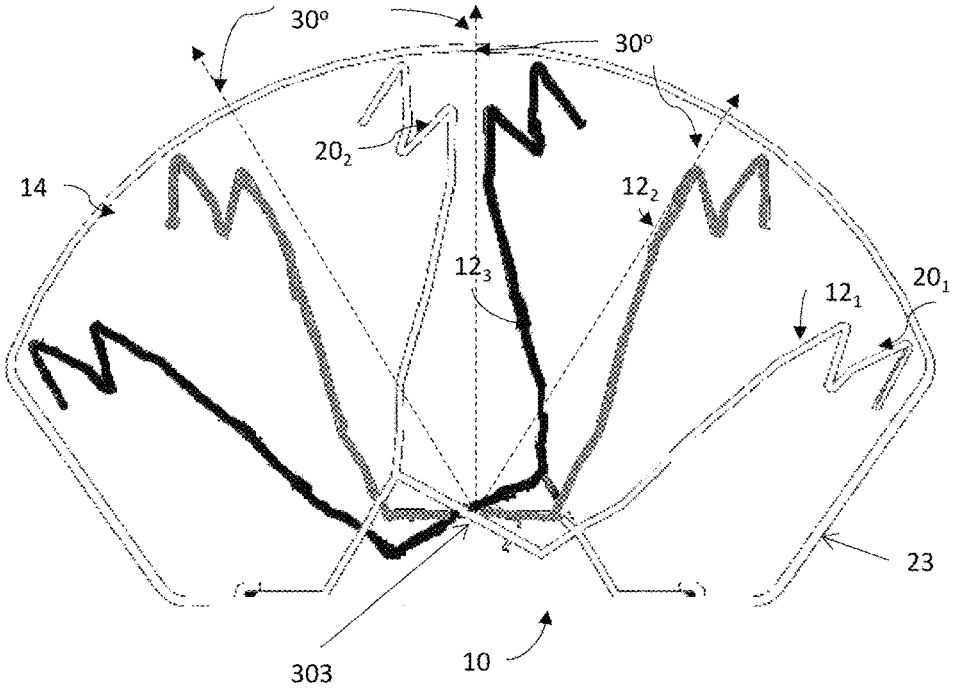
FIG. 3A is a profile illustrating the three sector region of one variation of an antenna, showing section through each of the three reflectors (one per sector) from a top view.

In general any of the linear antenna assemblies described herein may include a plurality of N antenna sections, where N≥2. In the example of an antenna assembly shown in FIGS. 2A-2D, there are three antenna sections (N=3). In this example, the linear antenna assembly 12, shows from left to right in FIG. 2A, a top, center, and bottom antenna sections $\mathbf{12}_1$, $\mathbf{12}_2$, $\mathbf{12}_3$, respectively, that have similar configurations (shape, sizes, etc.) but are radially off-set from each other by 30 degrees. Each antenna section 12*n*, includes a pair of walls and a back (base) forming a trough, e.g. a long open receptacle, having an open width that is larger than its base width, two walls and a base. For each antenna section, (optional) corrugations $\mathbf{20}_1$, $\mathbf{20}_2$ may be positioned at the open edge of each of the first and second walls. In addition to or instead of the corrugations, other edge/wall patterns, shapes and materials, such as notches, may be used to provide electromagnetic wave isolation to improve the directional coverage of each antenna sections, which may also suppress radio waves (e.g., noise and interference) between/to adjacent antenna sections. Electromagnetic absorbing or insulating materials may also be placed on the outer edge of the trough. A radiator array 22*n* may be positioned at the base of the antenna section 12*n*. A first isolation wall $\mathbf{24}_1$ (corrugation region) interposes and abuts the top and the center antenna sections $\mathbf{12}_1$, $\mathbf{12}_2$. A second isolation wall $\mathbf{24}_2$ (corrugation region) interposes and abuts the center and bottom antenna sections $\mathbf{12}_2$, $\mathbf{12}_3$. FIG. 3A further illustrates a cross-sectional view of the corrugations $\mathbf{20}_1$, $\mathbf{20}_2$ shown in FIG. 2A. In one variation, the depth of the corrugation is 12.5 mm and a spacing of 1.5 mm. For this example, each corrugation is formed by at least two fins.

The corrugations $\mathbf{20}_1$, $\mathbf{20}_2$, (as well as the isolation dividers $\mathbf{24}_1$, $\mathbf{24}_2$) may reduce signal interference to adjacent antenna sections, and/or adjacently located radio antennas.

FIG. 3A illustrates cross-sectional positions of antenna sections $\mathbf{12}_1$, $\mathbf{12}_2$, $\mathbf{12}_3$ in an example of a multi-sector antenna assembly such as the one shown in FIGS. 1A-2G. In this example, the antenna sections are positioned such that in cross-section, they share a common axis (first axis 303) along the longest length of the antenna assembly. Within each antenna section, an antenna array may act as a directional antenna that directs waves in one particular direction. Typically, the lobe in the direction bounded by the walls of the antenna section is referred to herein as the "main lobe". The axis of maximum radiation, passing through the center of the main lobe, may be referred to herein as the "beam axis" or "boresight axis". The antenna sections are positioned such that the beam axes are unique (i.e., pointing at different directions) and may be configured to originate from a common vertical axis 303. The beam-angle of an antenna section may be referenced as the angle in the horizontal plane, formed by the right and left most electromagnetic beam emitting from the radiator within the antenna section, which is bonded by walls of the trough (i.e., the beam-angle is constrained by the positions of two walls angularly disposed relative to the radiators within each of the antenna sections). For example, in the antenna sections shown in FIG. 3A, each antenna section has a beam-angle of 60 degrees. Referring to the center antenna section, as shown in FIG. 3A, the right most electromagnetic beam is exiting the trough at 30 degrees to the right of the beam axis, and the left most electromagnetic beam is exiting the trough at 30 degrees to the left of the beam axis, forming a 60 degree beam-angle. This description references the horizontal electromagnetic radiation pattern, which may be plotted as a function of azimuth about the antenna. The combined beam-angle of the linear array corresponds to the superposition of the horizontal-plane electromagnetic radiation patterns of each antenna section on a polar coordinate system. The origin corresponds to the central axis. Referring again to FIG. 3A, the right wall of the rightmost antenna section wall corresponds to 0 degrees and the left wall of the leftmost antenna section wall corresponds to the combined beam-angle of the antenna assembly. In this example, the antenna assembly has a combined beam-angle of 120 degree.

As discussed above, the walls of the trough may confine the radiation or radio frequency (RF) emission of the radiators located within the through. The choke boundary region (e.g., corrugations) at the top of the trough walls may further suppress radiation in extraneous directions (i.e., prevent or suppress radio wave radiations in other directions that may interfere with antenna sections adjacent to the main antenna section).

Figure 3B:
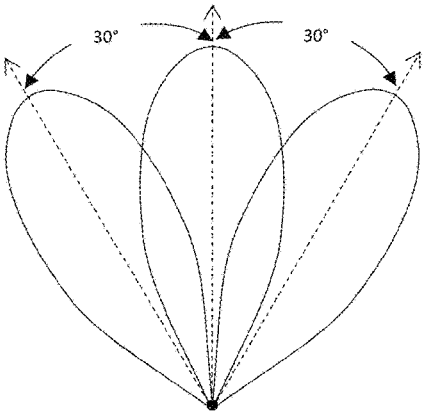
FIG. 3B is an antenna diagram showing the main lobe corresponding to each sector of a multi-sector antenna such as the one shown in FIGS. 1A-2K (e.g., having three sectors).

In the particular example shown in FIG. 3B, the linear antenna assembly is configured with three sector antenna sections, each pointing at a different direction, with the beam axis for each of the antenna section being approximately 30 degree off-set from an adjacent antenna section's beam axis. The antenna sections in this example have identical horizontal radiation patterns, e.g. each antenna section's main lobe has a half-power beamwidth of about 30 degrees. The center antenna section has a beam axis positioned perpendicular to the back of the trough. For illustrative purposes, the back of the central antenna section corresponds to the x-axis and the perpendicular axis corresponds to the y-axis. The top antenna section has a beam axis that is 30 degrees to the right of the y-axis. The bottom antenna section has a beam axis that is 30 degrees to the left of the y-axis. In this example, the main lobes of the antenna sections are configured to overlap at the half-power point, and the three antenna sections form a combined beamwidth (for the antenna assembly) of about 90 degrees. By modifying position of an antenna section one can change the direction of the beam axis for a particular antenna section. The main lobe for an antenna section may be modified by changing the angle or shape of the trough, changing the design of the radiator located in the trough, or modifying the corrugation at the top of the trough walls, or a combination thereof. The number of antenna sections (N) in the assembly could be changed, the direction of the beam axis for each of the antenna sections could be changed, and the main lobe (or the radio antenna's emission pattern) may be modified to meet design requirements and to provide a desired coverage area.

The orientation of the adjacently positioned (stacked) antenna sections in an antenna assembly may be varied. For example, FIGS. 3C-3H schematically illustrate different variations of linear assemblies having different orientations of each of three antenna sections within the assembly. Each trapezoid shown corresponds to an antenna section. In these examples, the antenna sections share a common axis. The cross-sectional plane of each antenna section is shown in the figures to illustrate the relative positions and directions of the antenna sections.

Figure 3I:
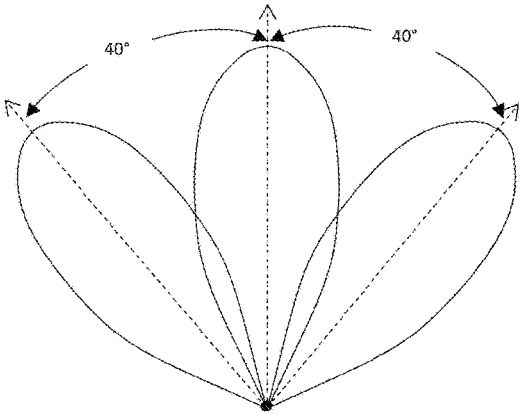
FIGS. 3I and 3J show antenna diagrams similar to the one shown in FIG. 3B for alternative variations of a multi-sector antenna.
Figure 3J:
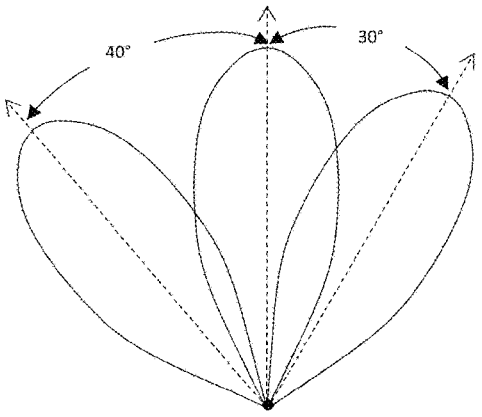
Figure 3C:
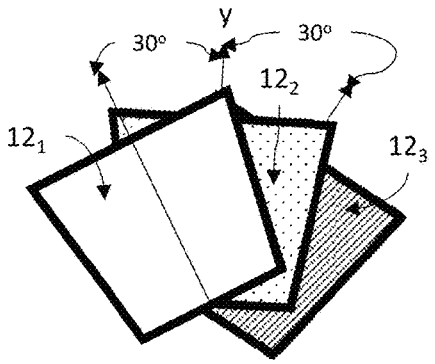
FIGS. 3C-3H schematically illustrate different arrangements of each sector of a multi-sector antenna having 3 sectors.

For example, in FIG. 3C, the beam axis of the top antenna section $\mathbf{12}_1$ is positioned to the left of the y-axis, the beam axis of the center antenna section $\mathbf{12}_2$ is positioned in the middle and corresponds to the y-axis, and the beam axis of the bottom antenna section $\mathbf{12}_3$ is positioned to the right of the y-axis. The beam axis of the top antenna section $\mathbf{12}_1$ is radially separated by 30 degrees from the beam axis of the center antenna section $\mathbf{12}_2$ and 60 degrees from the beam axis of the bottom antenna section $\mathbf{12}_3$.

Figure 3D:
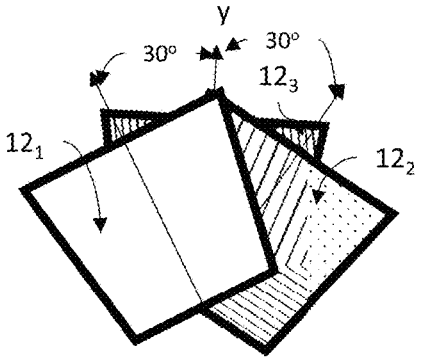

In FIG. 3D, the beam axis of the top antenna section $\mathbf{12}_1$ is positioned to the left of the y-axis, the beam axis of the center antenna section $\mathbf{12}_2$ is positioned to the right of the y-axis and the beam axis of the bottom antenna section $\mathbf{12}_3$ is positioned in the middle and corresponds to the y-axis. The beam axis of the top antenna section $\mathbf{12}_1$ is radially separated by 60 degrees from the beam axis of the center antenna section $\mathbf{12}_2$ and 30 degrees from the beam axis of the bottom antenna section $\mathbf{12}_3$.

Figure 3E:
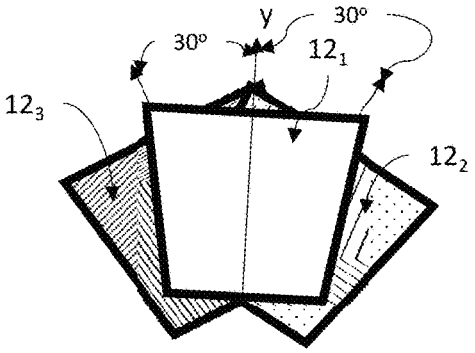

In FIG. 3E, the beam axis of the top antenna section $\mathbf{12}_1$ is positioned in the middle and corresponds to the y-axis, beam axis of the center antenna section $\mathbf{12}_2$ is positioned to the right of the y-axis, and the beam axis of the bottom antenna section $\mathbf{12}_3$ is positioned to the left of the y-axis. The beam axis of the top antenna section $\mathbf{12}_1$ is radially separated by 30 degrees from the beam axis of the center antenna section $\mathbf{12}_2$ and 30 degrees from the beam axis of the bottom antenna section $\mathbf{12}_3$.

Figure 3F:
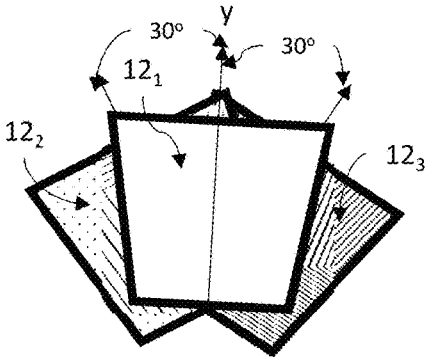

In FIG. 3F, the beam axis of the top antenna section $\mathbf{12}_1$ is positioned in the middle and corresponds to the y-axis, beam axis of the center antenna section $\mathbf{12}_2$ is positioned to the left of the y-axis, and the beam axis of the bottom antenna section $\mathbf{12}_3$ is positioned to the right of the y-axis. The beam axis of the top antenna section $\mathbf{12}_1$ is radially separated by 30 degrees from the beam axis of the center antenna section $\mathbf{12}_2$ and 30 degrees from the beam axis of the bottom antenna section $\mathbf{12}_3$.

Figure 3G:
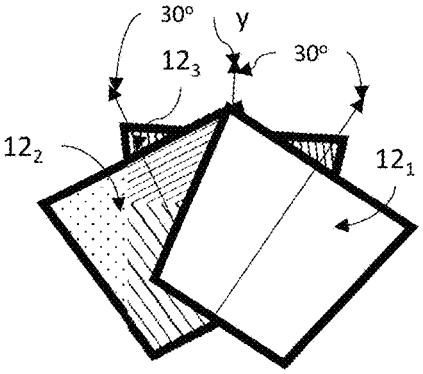

In FIG. 3G, the beam axis of the top antenna section $\mathbf{12}_1$ is positioned to the right of the y-axis, the beam axis of the center antenna section $\mathbf{12}_2$ is positioned to the left of the y-axis, and the beam axis of the bottom antenna section $\mathbf{12}_3$ is positioned in the middle and corresponds to the y-axis. The beam axis of the top antenna section $\mathbf{12}_1$ is radially separated by 60 degrees from the beam axis of the center antenna section $\mathbf{12}_2$ and 30 degrees from the beam axis of the bottom antenna section $\mathbf{12}_3$.

Figure 3H:
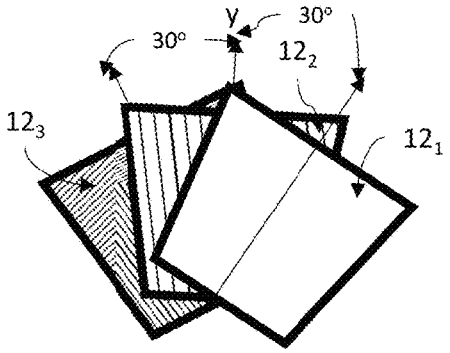

In FIG. 3H, the beam axis of the top antenna section $\mathbf{12}_1$ is positioned to the right of the y-axis, the beam axis of the center antenna section $\mathbf{12}_2$ is positioned in the middle and corresponds to the y-axis, and the beam axis of the bottom antenna section $\mathbf{12}_3$ is positioned in the left of the y-axis. The beam axis of the top antenna section $\mathbf{12}_1$ is radially separated by 30 degrees from the beam axis of the center antenna section $\mathbf{12}_2$ and 60 degrees from the beam axis of the bottom antenna section $\mathbf{12}_3$.

In some variations, the beam-angles of the different antenna sections forming the antenna assembly may be more or less angled relative to each other. For example, the antenna sections may have differing main lobes or half power beamwidths. The main lobe configurations may be altered by changing the performance characteristics of the radiator array, e.g. number of columns, number of elements in each column, the angular position and/or shape of the walls, etc. One of ordinary skill in the art having the benefit of this disclosure can extend the concept so that the combined output beamwidth of the antenna sections is different by varying the position of the beam axes of the antenna sections, and varying the main lob of each of the antenna sections, while maintaining partial overlapping with the adjacent region. This will change the region spanned by the electromagnetic waves emitted from each of the antenna sections. An example of one variation is shown in FIG. 3I, using the antenna sections where each main lobe has a half power beamwidth of 30 degrees, the beam axis of the center antenna section corresponds to the y-axis. The beam axis of the right antenna section is separated by 40 degrees from the y-axis. The beam axis of the left antenna section is separated by 40 degrees from the y-axis. Alternatively, the beam axes need not be evenly spaced. Using the same antenna sections, the beam axis of the center antenna section corresponds to the y-axis. The beam axis of the right antenna section may be separated by 30 degrees from the y-axis, while the beam axis of the left antenna section may be separated by 40 degrees from the y-axis as shown in FIG. 3J.

In some variations, each antenna section $\mathbf{12}_1$, $\mathbf{12}_2$, $\mathbf{12}_3$ is a sector antenna. In one variation, each sector antenna may have a main lobe having a beamwidth of 60 degrees. The antenna sections may be positioned such that the main lobs of the adjacent antennae overlaps at the half-power point, such that the three antenna sections forms a combined beamwidth of 180 degrees. In another variation, at least two of the antenna sections have different main lobes or beamwidths. In operation, the plurality of antenna sections behave as one antenna providing coverage over a range of areas or sectors.

Other examples of antenna assemblies having different numbers and arrangements of in-line antenna sections are shown schematically in FIGS. 4A-4E. In these examples, the antenna sections are shown looking down along the long axis (first axis) of the antenna assembly. Each antenna assembly may include a first side, a second side and a base forming an open and elongate trough-like assembly as described above. The individual antenna sections in each example may have the same general configuration or they may be different configurations. In FIGS. 4A-4E, each antenna section is represented in the top view as a trapezoid; different antenna sections have different shadings.

Figure 4A:
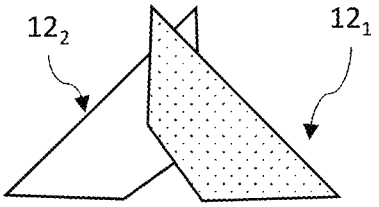
FIGS. 4A-4E illustrate variations of multi-sector antennas comprising a linear assembly.
Figure 4B:
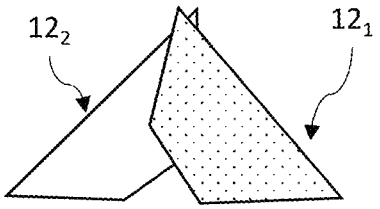

For example, FIG. 4A shows a variation in which the combined beam-angle of the antenna assembly is approximately 180 degrees. In this example, each antenna section has a beam-angle of approximately 90 degrees, and the antenna sections share the same central axis, are stacked on each other (N=2 antenna sections) and have similarly positioned walls. The radiator arrays within each section may be similar in length. Similarly, in FIG. 4B the antenna assembly has a combined beam-angle of 180 degrees, however, one antenna section has a beam-angle of larger than 90 degrees, while the other has a beam-angle of less than 90 degrees. The radiator arrays within each section may be similar in length. There are two antenna sections shown. Thus, in this example, the beamwidths may be different.

Figure 4C:
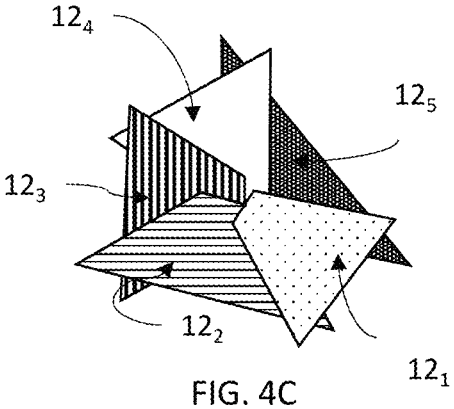

FIG. 4C shows an example of an antenna assembly with a combined beam-angle is 360 degrees using five antenna sections (N=5). The antenna sections have dissimilar main lobe shapes and different beamwidths. The radiator arrays within each section may be varying in length.

Figure 4D:
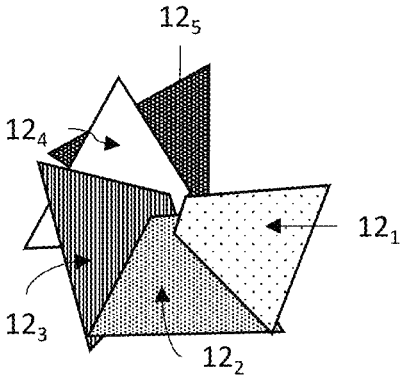

FIG. 4D shows a variation in which the combined beam-angle is approximately 270 degrees, using five antenna sections (N=5). The antenna sections in this example have different main lobes (and, as above, different configurations of the antenna sections) and therefore have different beam-angles. The radiator arrays within each section may vary in length.

Figure 4E:
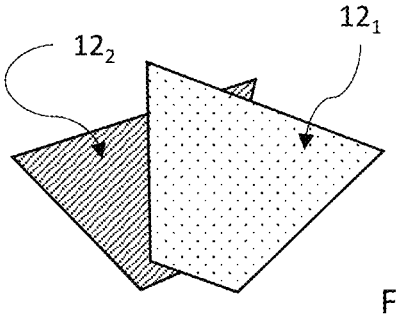

Another example is shown in FIG. 4E in which the combined beam-angle is approximately 90 degrees, using two antenna sections (N=2). The antenna sections in this example have similar structures and corresponding main lobes and therefore have similar half-power beamwidths.

Figure 4F:
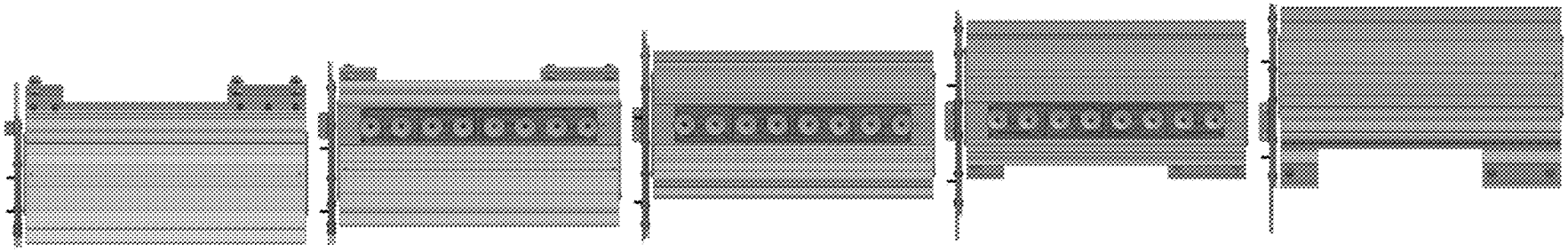
FIGS. 4F and 4G illustrate variations of multi-sector antennas having five (N=5) and four (N=4) antenna sections, respectively.
Figure 4G:
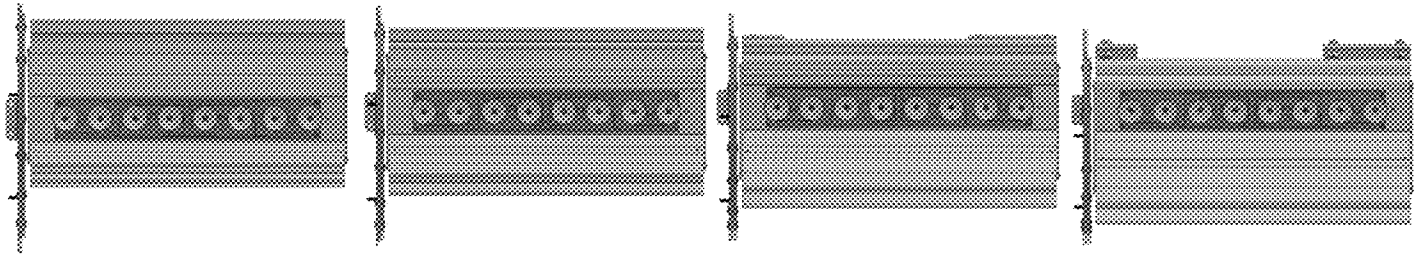

FIGS. 4F and 4G show variations of the antenna apparatuses described herein having five (N=5) and four (N=4) antenna sections, respectively. Each antenna section is separated from adjacent antenna sections by an isolation plate, as described herein. In FIGS. 4F and 4G, some features (including the pole mounts, radome, back region, etc. have been removed for clarity, but these apparatuses may be similar (and may share similar features with) any of the other embodiments described herein.

Figure 5A:
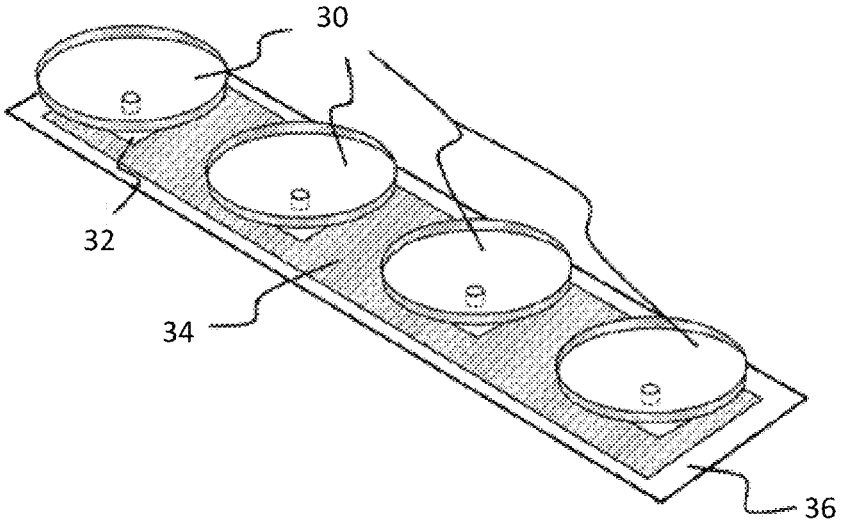
FIG. 5A shows one variation of an array of radiating elements (radiators/receivers) having four radiating elements.
Figure 5B:
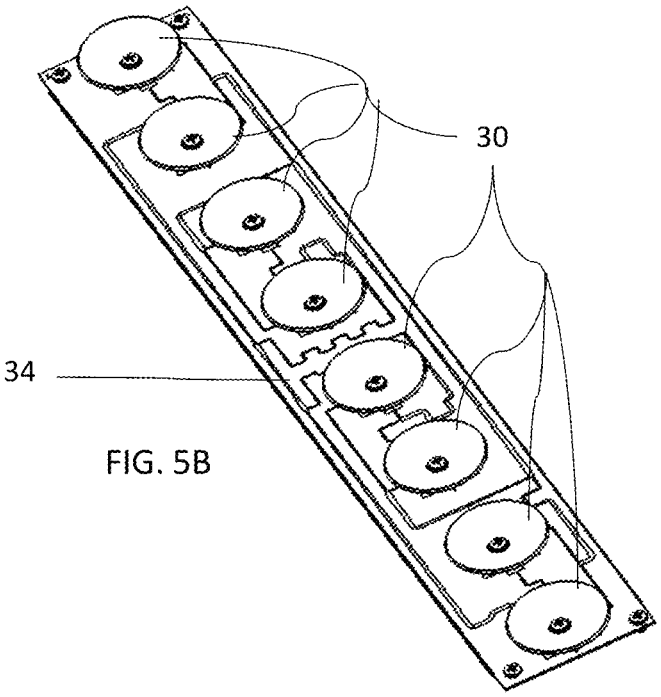
FIG. 5B shows another example of an array of radiating elements (radiators/receivers) having eight radiating elements.

In any of the examples described herein, each antenna section may include one or more emitting elements for emitting and/or receiving RF energy. In particular, each antenna section may include a plurality of emitters (emitting elements) that are arranged in an array, such as in a linear array that can be oriented in-line with the long axis of the antenna assembly. For example, FIGS. 5A and 5B illustrate examples of radiator arrays $\mathbf{22}_n$. As mentioned, each antenna array $\mathbf{22}_x$ may include multiple radiators (radiating elements 30). The multiple radiators 30 may be coupled to a corresponding radio transmitter/receiver (e.g., transmitter, receiver, transceiver, etc.). For example, in an array of radiators, each radiator 30 may be mounted on a dielectric surface 32. The patch 34 may be formed from electrically conductive material and may be formed from the same material as the radiator. The dielectric surfaces may be disposed on a ground plane 36. Disposing the radiators in an array at or above the patch provides for control of the radiation pattern produced by the antenna array. Placement of radiators may reinforce the radiation pattern in a desired direction and suppressed in undesired directions.

In some variations, such as the examples shown in FIGS. 5A and 5B, each radiator element 30 is a hollow metallic conical portion, having a vertex end and a base end. A first cylindrical portion disposed annularly about the base end of the conical portion and a second metallic cylindrical portion coupled to the vertex of the conical portion. The cylindrical portion on the vertex end may have an aperture for receiving an antenna feed from a radio transmitter. The aperture may be threaded. One of ordinary skilled in the art having the benefit of this disclosure would appreciate that other radiator designs may be implemented in the multi-directional antenna design disclosed herein, including, but not limited to, various patch antenna arrays, pin or rod shaped radiator arrays. In some variations, instead of a radiator array, each antenna sections houses a single radiator element.

An antenna assembly may have one or more emitter elements that include a patch portion connected to the second cylindrical portion. The patch portion may have an aperture through it. The patch is disposed on an insulator such as a printed circuit board, and a metallic ground portion may also be connected to an insulator opposite the patch. The ground portion may have an aperture through it for receiving a fastener. The screw may be used to connect together the ground, the patch, the insulator and the cone. The screw or other fastener may also hold in place a radio frequency (RF) feed to the threaded aperture on the conical portion. Additionally an RF feed may be adhered to the patch and a portion of the cylinder on the vertex end disposed in electrical contact with the RF feed.

The device may be arranged in an array to provide for an effective radiation pattern and the elements or the array and height of the radiators positions to provide for impedance matching and improved antenna gain.

Another example of a multi-sector antenna apparatus (assembly) is shown in FIGS. 6A-9C. In this example, the apparatus include three antenna sections, each in-line in the vertical axis, but pointing at different directions. Each antenna section includes a radio apparatus (e.g., RF radio transceiver) connection.

Figures 6A, 6B, 6C:
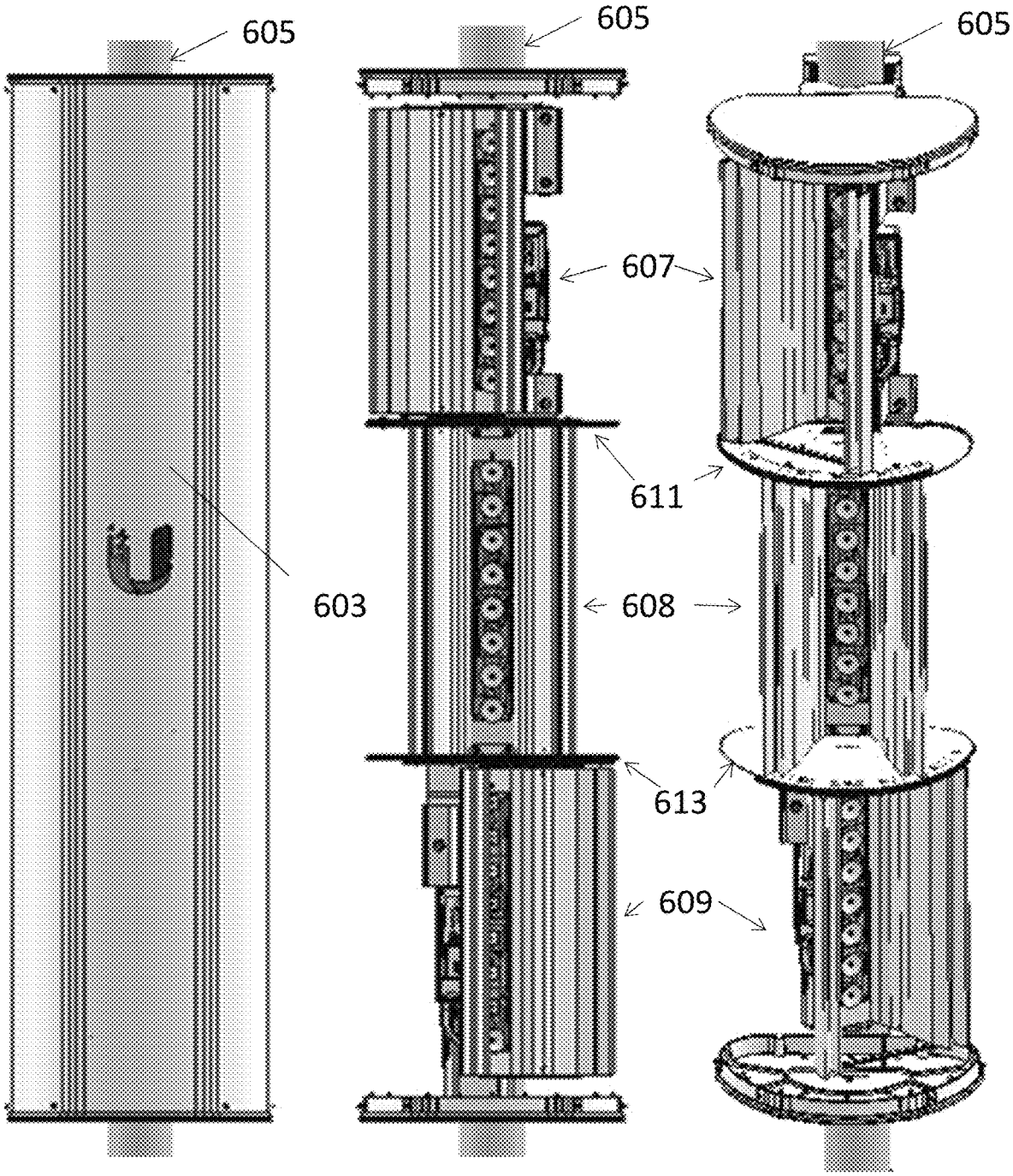
FIG. 6A is a front view of another variation of a multi-sector antenna as described herein.
FIG. 6B shows the multi-sector antenna of FIG. 6A with the outer cover (e.g., radome) removed, showing the three different reflector regions, separated by boundary plates having stacked corrugated edges.
FIG. 6C is a front perspective view similar to that shown in FIG. 6B.

For example, FIG. 6A shows the outside radome 601 structure covering the antenna assembly. The apparatus is shown mounted vertically to a pole or post 605. FIG. 6B shows the apparatus with the radome removed, showing the three stacked antenna sections 607, 608, 609, each pointing in a different direction (separated by 30 degrees). The three sections are also each separated by an isolation plate 611, 613 having a corrugated edge (not visible in FIG. 6B or 6C).

Figure 7A:
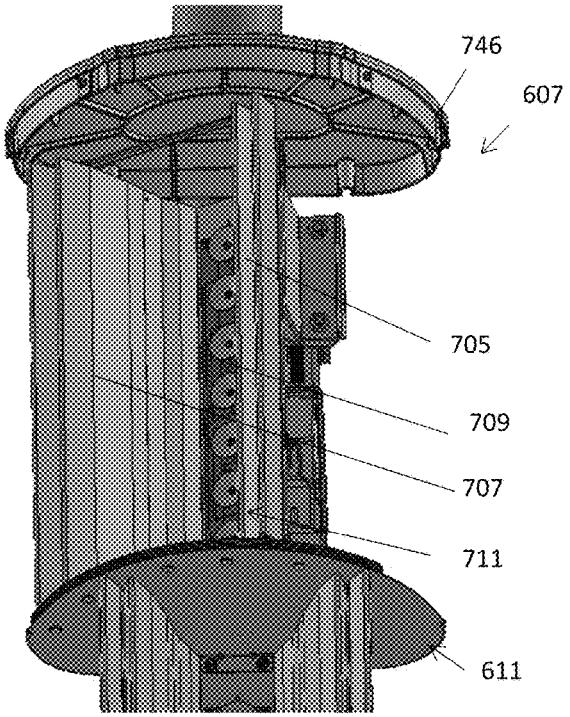
FIG. 7A is an enlarged perspective view of the upper antenna portion of the multi-sector antenna of FIGS. 6A-6C.
Figure 7B:
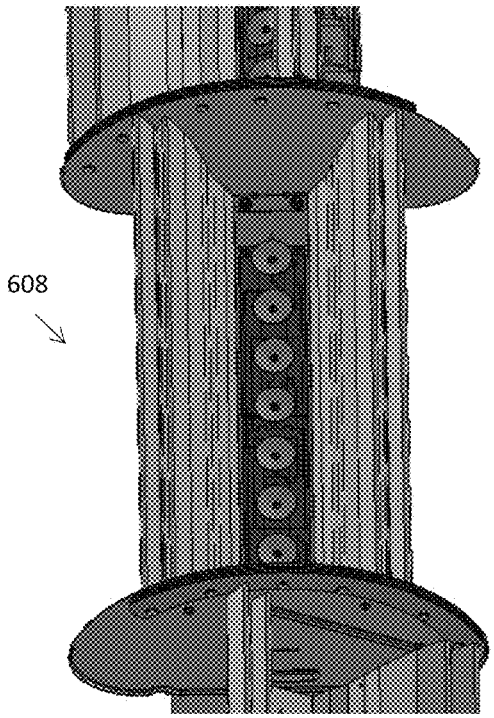
FIG. 7B is an enlarged perspective view of the middle antenna portion of the multi-sector antenna of FIGS. 6A-6C.
Figure 7C:
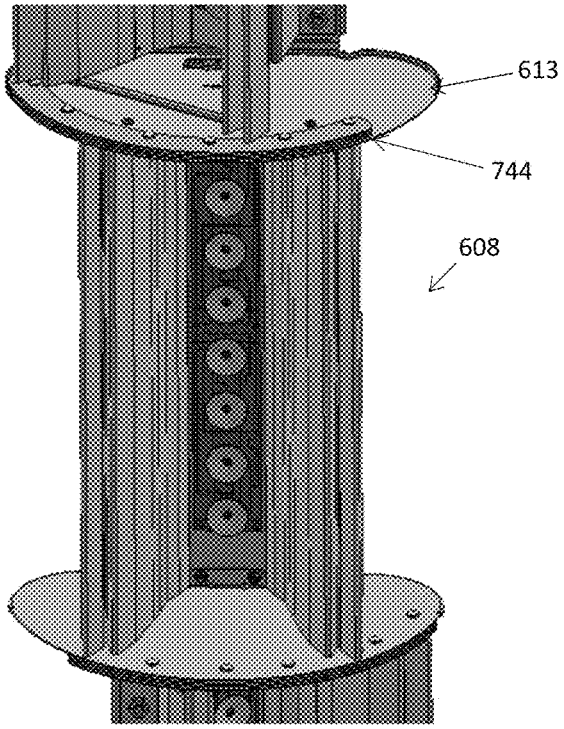
FIG. 7C is an alternative perspective view of the middle antenna portion of the multi-sector antenna of FIGS. 6A-6C, showing a different angle.

FIG. 7A shows a closer view of the top antenna section 607 from a front view, showing a pair of side walls 705, 707 on either side of the linear (vertical) array of disc-shaped emitters 709, which may be mounted onto a back or base 711. The side walls (and in some variations, the base) may form the reflector portion of each antenna section; these side walls may be long and parallel, forming a trough-like structure. An isolation plate 611 is located between the top antenna section and a middle antenna section 608. FIG. 7B illustrates a perspective view of the middle antenna section 608. FIG. 7C shows another perspective view (looking downward) on the middle antenna section 609, and FIG. 7D shows the bottom antenna section.

In FIGS. 7A-7D, the isolation plates 611, 613 are visible. Similar isolation plates are described in greater detail in FIGS. 10A-11G, below. As can be seen in FIG. 7C the corrugated region 744 formed along an outer edge of the isolation plate. In this example, the corrugated region extends only partially around the outer edge of the isolation plate, in the upper isolation plate 611 extending primarily between the opening into the antenna emitter array formed by the walls of the upper antenna section 607 and the middle antenna section 608, and in the lower isolation plate 613 between the opening into the antenna emitter array formed by the walls of the middle antenna section 608 and the lower antenna section 609. In some variations this choke region extends completely around the outer edge of the isolation plate; in other variations the choke region extends only between the walls of the upper and/or lower antenna sections that it is positioned between.

Figure 7D:
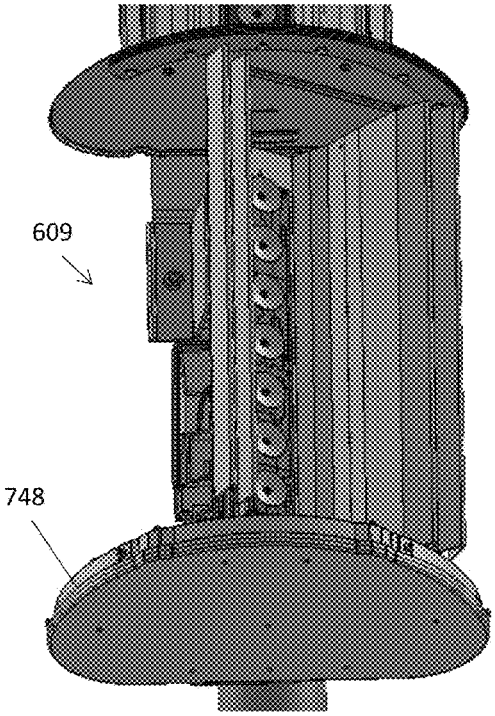
FIG. 7D is a perspective view of the bottom antenna portion of the multi-sector antenna of FIGS. 6A-6C.

In FIGS. 7A and 7D, the top and bottom of the antenna assembly do not include an isolation plate, although they are covered by an upper cap 746 and a lower cap 748. Alternatively, in some variations the upper and/or lower cap may include or be configured as isolation plates (e.g., may include a corrugated/choke region).

Figure 8A:
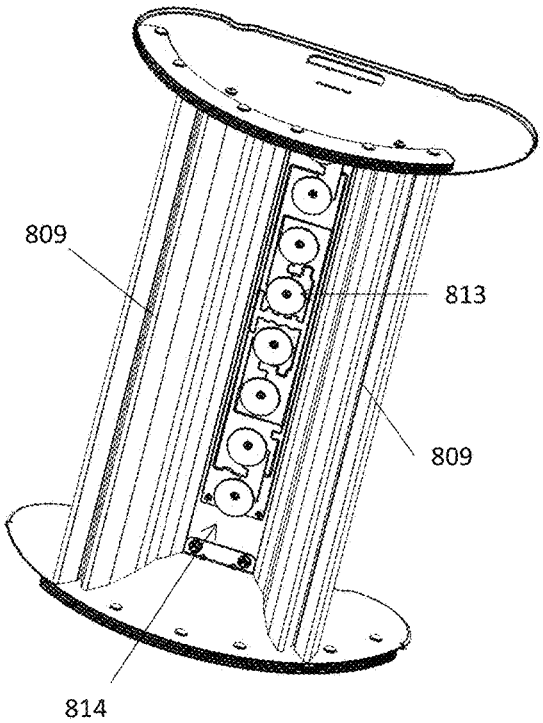
FIG. 8A is a perspective view of one antenna section as described herein.
Figure 8B:
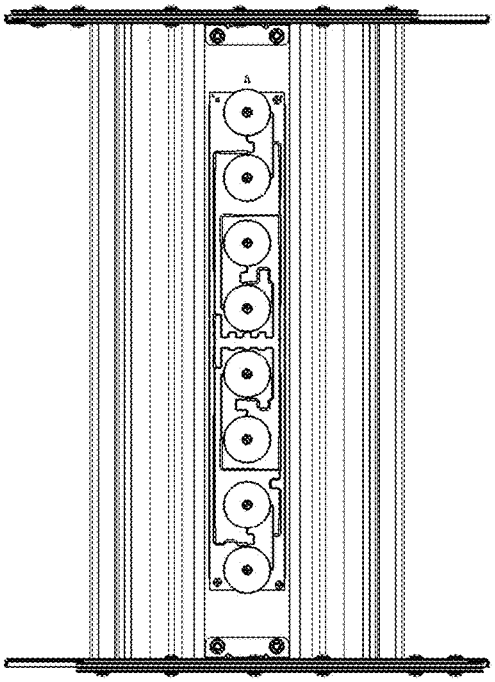
FIGS. 8B, 8C, and 8D are front, back and side views, respectively, of antenna sections as described herein.
Figure 8C:
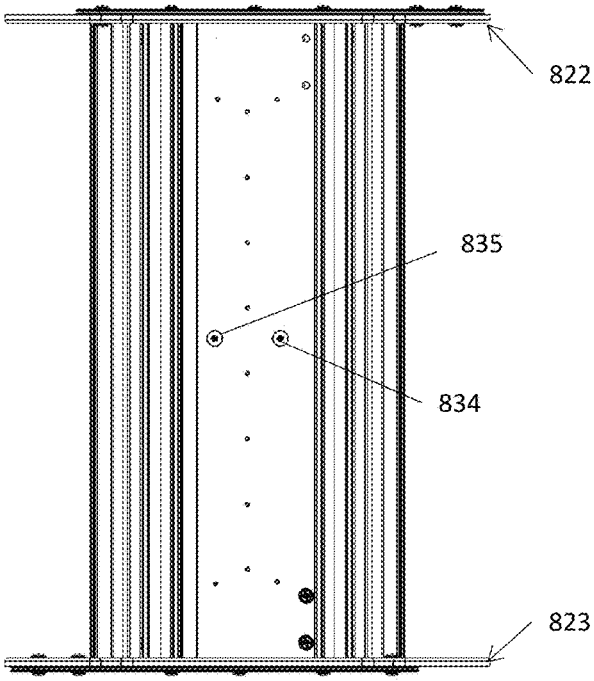

FIGS. 8A-8F illustrate an example of an antenna section; in this example, the antenna section is similar to the middle antenna section 608 described above. For example, FIG. 8A shows an antenna section including a pair of walls 807, 809 that connect to a back region 811, onto which an array of eight disc-shaped emitters 813 are mounted to a base 814 including feed lines and a ground plate. FIG. 8B shows a front view, while FIG. 8C shows a back view. Inputs may be made from one or more radio transceivers though radio connections 834, 835. Multiple polarization inputs (e.g., horizontal and vertical polarization inputs) may be used.

Figure 8D:
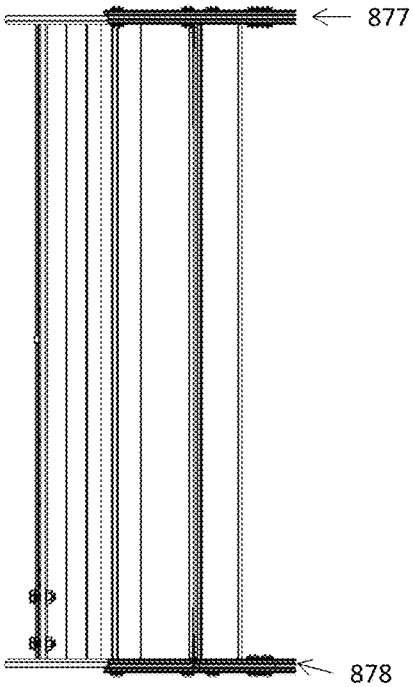

In FIGS. 8A-8F, the antenna section includes an upper and a lower isolation plate 822, 823 are included. In FIG. 8D, the side view shows the profile of the upper 877 and lower 878 isolation plate, including the corrugations forming the choke boundary.

Figure 8F:
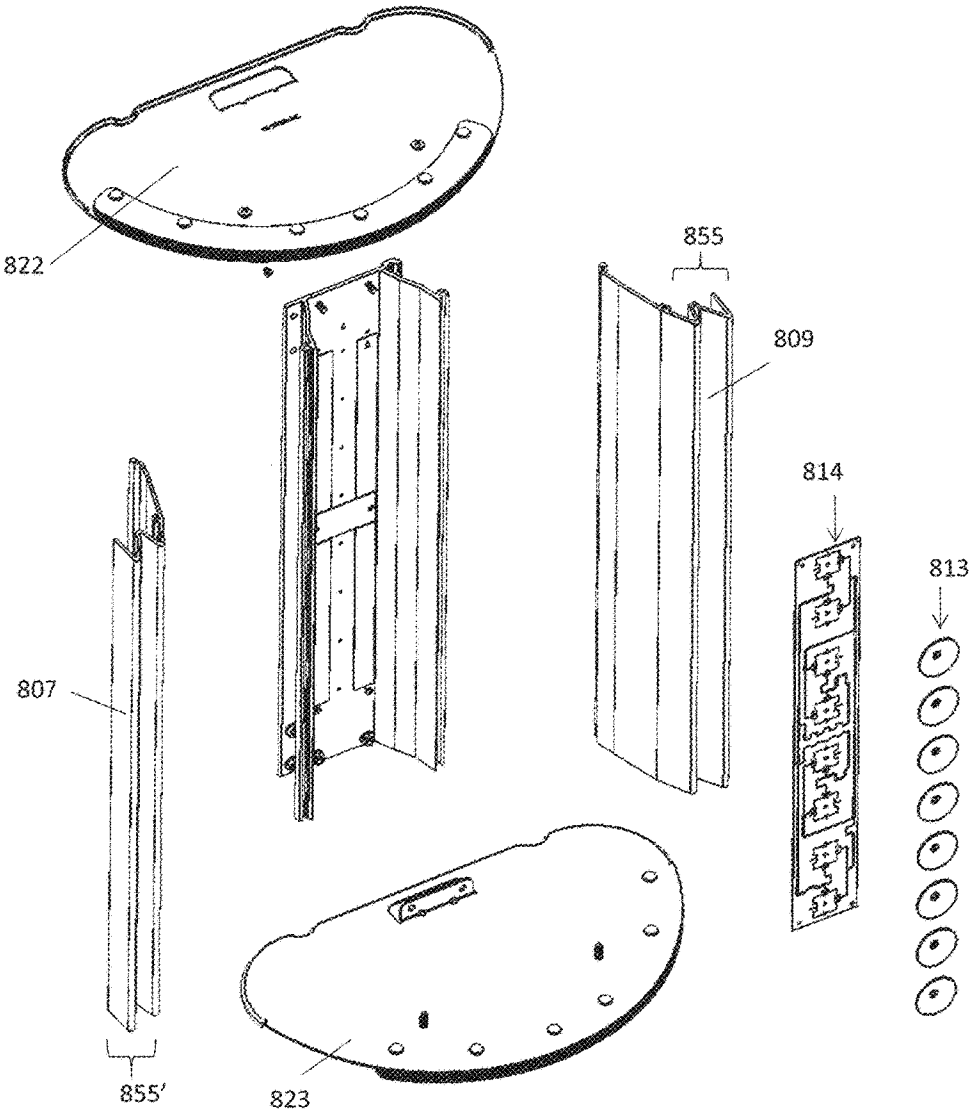
FIG. 8F is a partially exploded view of the antenna section shown in FIG. 8E.
Figure 8E:
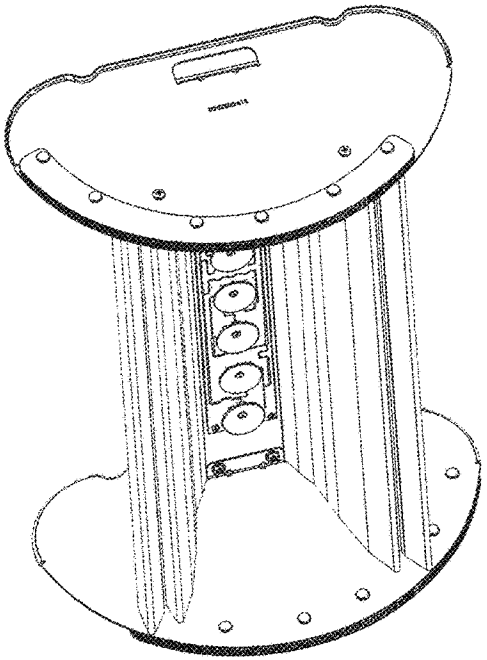
FIG. 8E is another perspective view of the antenna section of FIG. 8A.

FIG. 8E shows another perspective view of an antenna section, and FIG. 8F shows an exploded view of the antenna section of FIG. 8E. In this example, the antenna section includes the upper 822 and lower 823 isolation plate with choke boundary regions along the outer edge, as well as a pair of side walls 807, 809, and back region 811. The emitter base 814 and array of emitters 813 are also included. Each of the side walls 807, 809 includes a corrugated portion 855', 855 formed at the outer edge by multiple fold of the elongate edge.

Figure 9A:
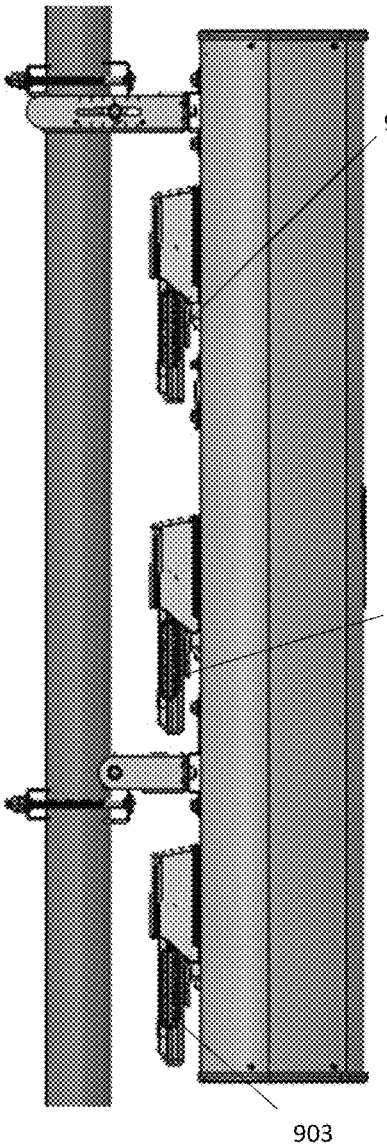
FIG. 9A is a side view of the multi-sector antenna of FIGS. 6A-7D.
Figure 9B:
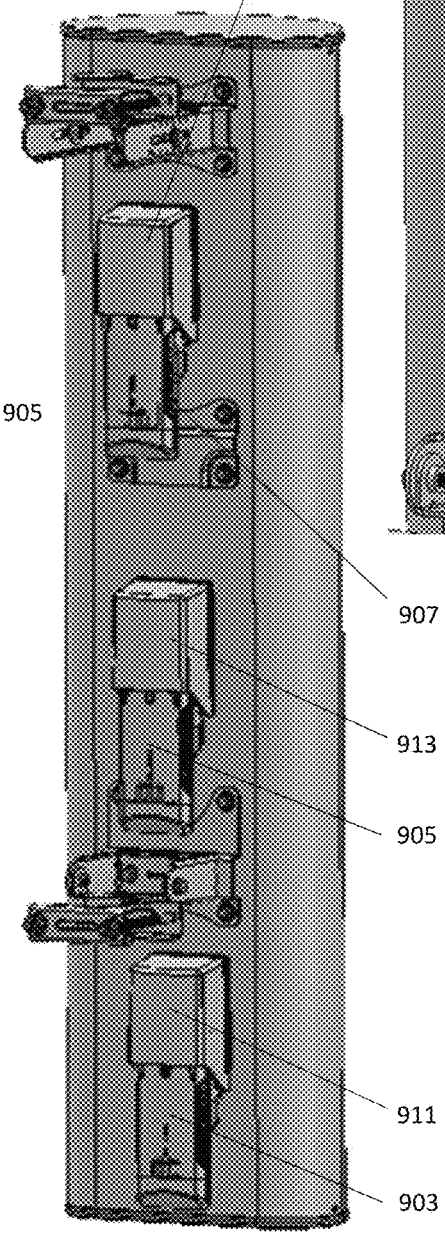
FIG. 9B is a back perspective view of the multi-sector antenna of FIGS. 6A-8F.
Figure 9C:
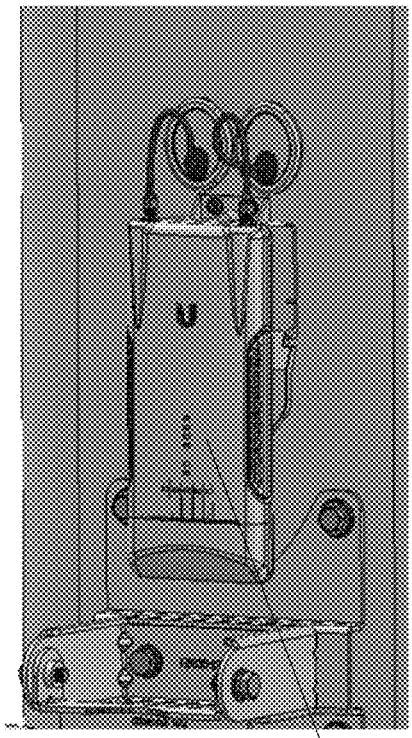
FIG. 9C is an enlarged view of a portion of the back of the multi-sector antenna of FIGS. 6A-8F.

As mentioned above, a plurality of different antenna sections may be coupled together in a stack to form an antenna assembly. Each of the different antenna sections may be fed by a single radio transceiver device or by separate radio transceiver devices. For example, as shown in FIGS. 9A-9C, each antenna section is fed (and may be fed in multiple polarities) by a separate radio transceiver 903, 905, 907 that is coupled to the back of the apparatus. The radio device may be held in a holder 911, 913, 915. The apparatus may also include a mount for coupling to a wall, post, pole, or other surface or structure.

Figure 10A:
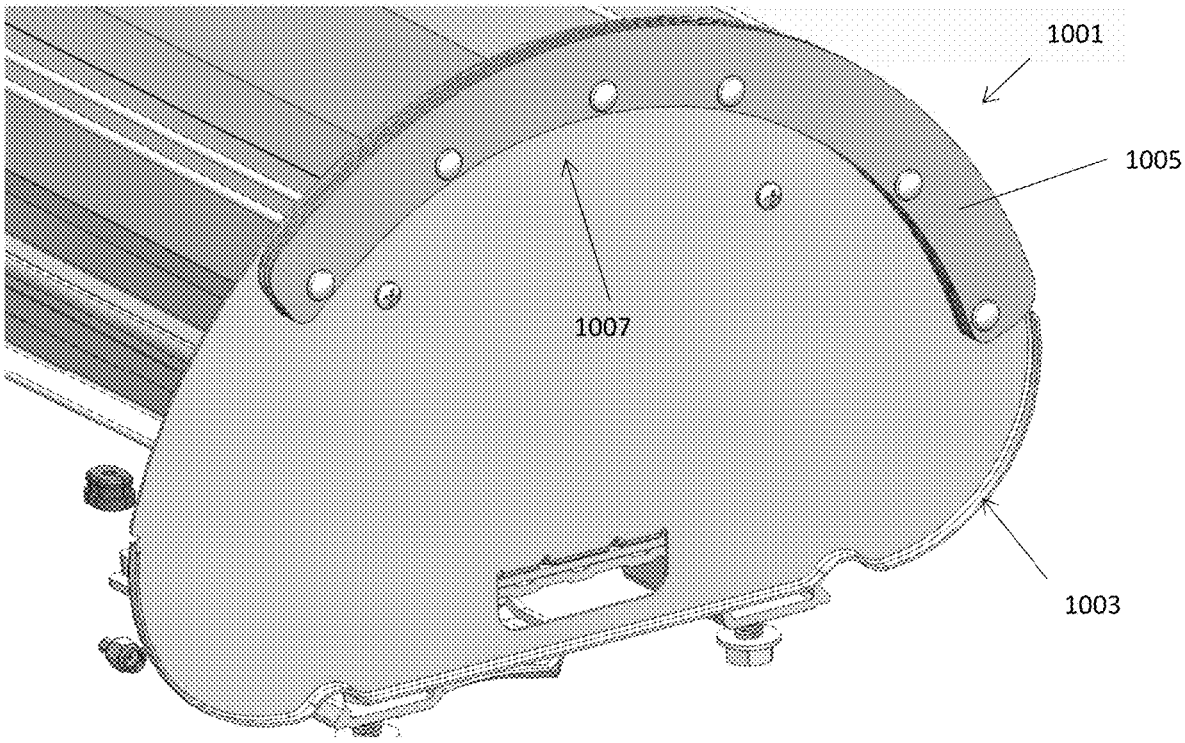
FIGS. 10A and 10B show perspective and bottom views, respectively, of an isolation plate portion between two of the antenna portions of a multi-sector antenna.
Figure 10B:
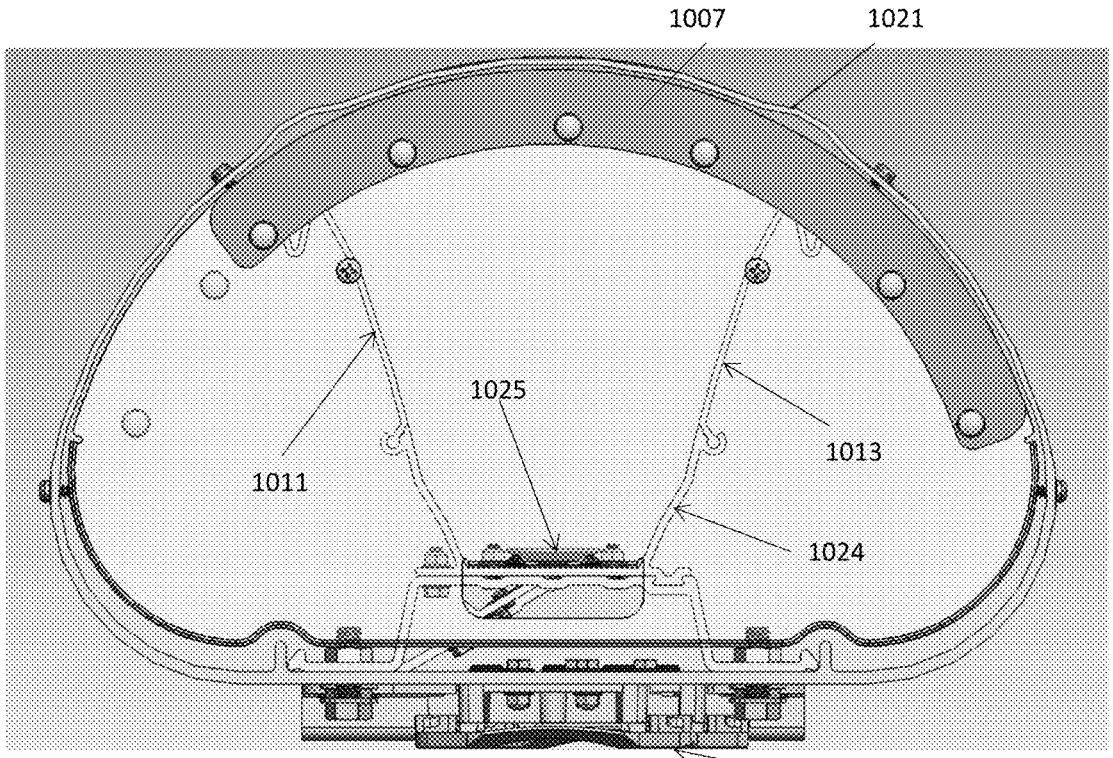

FIGS. 10A and 10B show perspective and end views, respectively, of one variation of an isolation plate, similar to the ones shown in FIGS. 7A-8F. In this example the isolation plate is a thin, flat plate 1001 having a curved outer edge that is not bent (e.g., does not have a lip) and a flattened back edge having a lip forming a curved, bent-over region 1003 that extends across the back portion and slightly up to the curved region. The plate may be formed of any appropriate material, including metallic, materials, and/or RF insulating materials. The lipped region is separated from the non-lipped region by a notch on either side. The lip 1003 is approximately the same width as the thickness of the corrugated region 1005. In FIGS. 10A and 10B, the corrugated (choke) region 1005 is formed by multiple stacked layers (which may be formed from the same material as the plate); each layer may be stacked onto another layer that is recessed from the outer edge by approximately ¼ wavelength (e.g., a of the average, median, and/or mean of the wavelengths transmitted to/from the antenna as discussed above). For example, in FIGS. 10A and 10B, there are six layers shown stacked atop each other, forming a choke region having three ridges comprising the alternating-sized strips. In this example, the choke region 1007 extends only partially around the outer, curved edge of the isolation plate. As shown in FIG. 10B, the walls 1011, 1013 of the antenna section form an opening that is bounded on one side (e.g., the bottom or top) by the choke plate, and at the outer edge by the choke region 1007. The two sides are connected to a back region 1024 to which the array of emitters 1025 are connected.

FIG. 10B also shows a section through the antenna assembly including an outer cover (radome) 1021, and a mount to the RF radio transceiver 1023. In operation, the isolation choke boundary may prevent or reduce interference and/or cross-talk between adjacent antenna sections by acting as a boundary between these regions. Without the choke boundary region of the isolation plate between the antenna sections, RF transmission between adjacent antenna sections may significantly interfere.

Figure 11A:
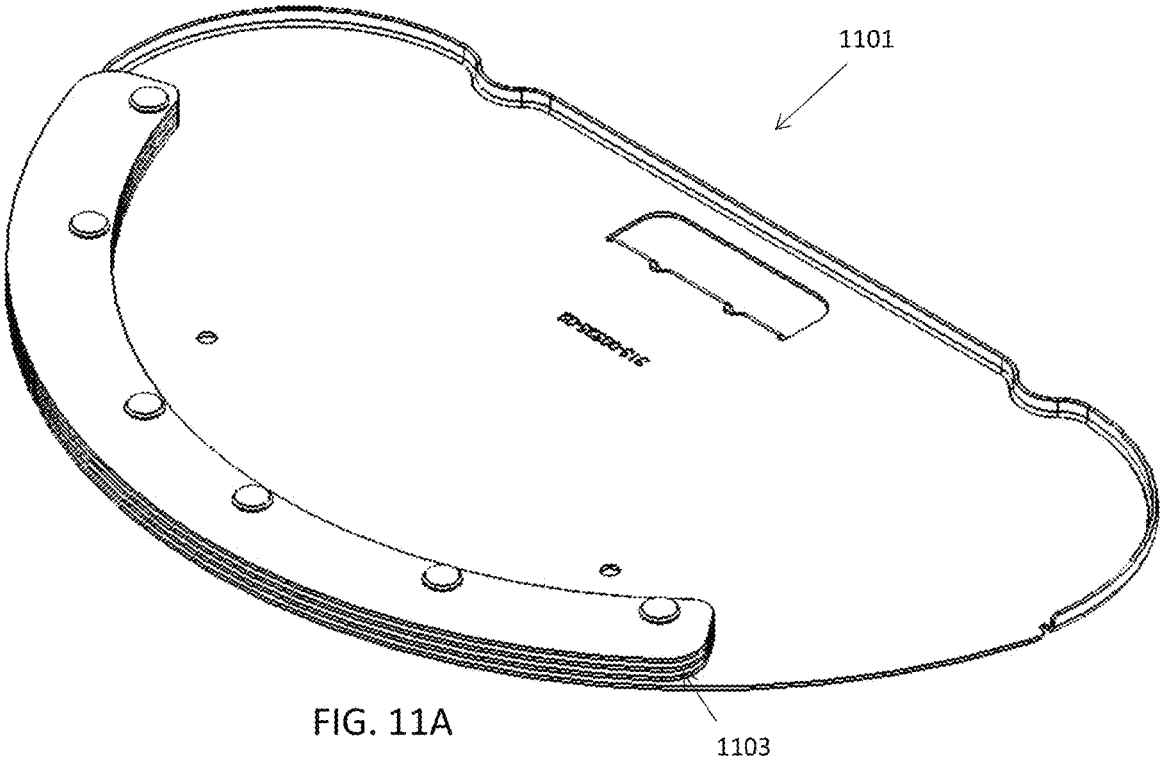
Figure 11B:
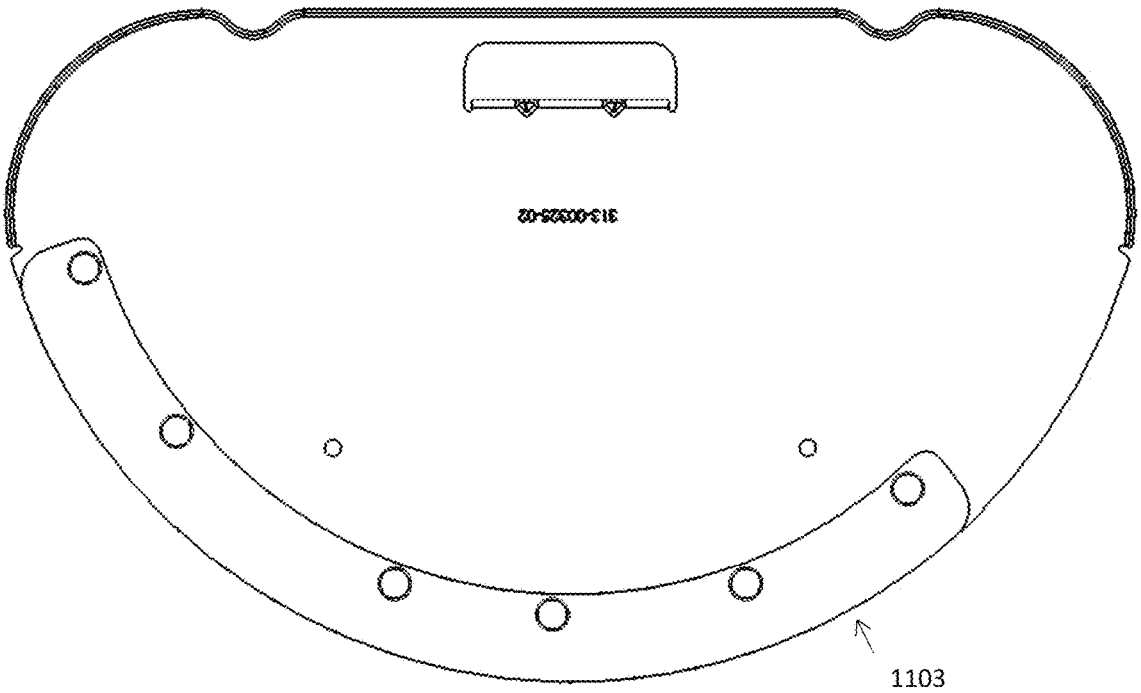
Figure 11C:
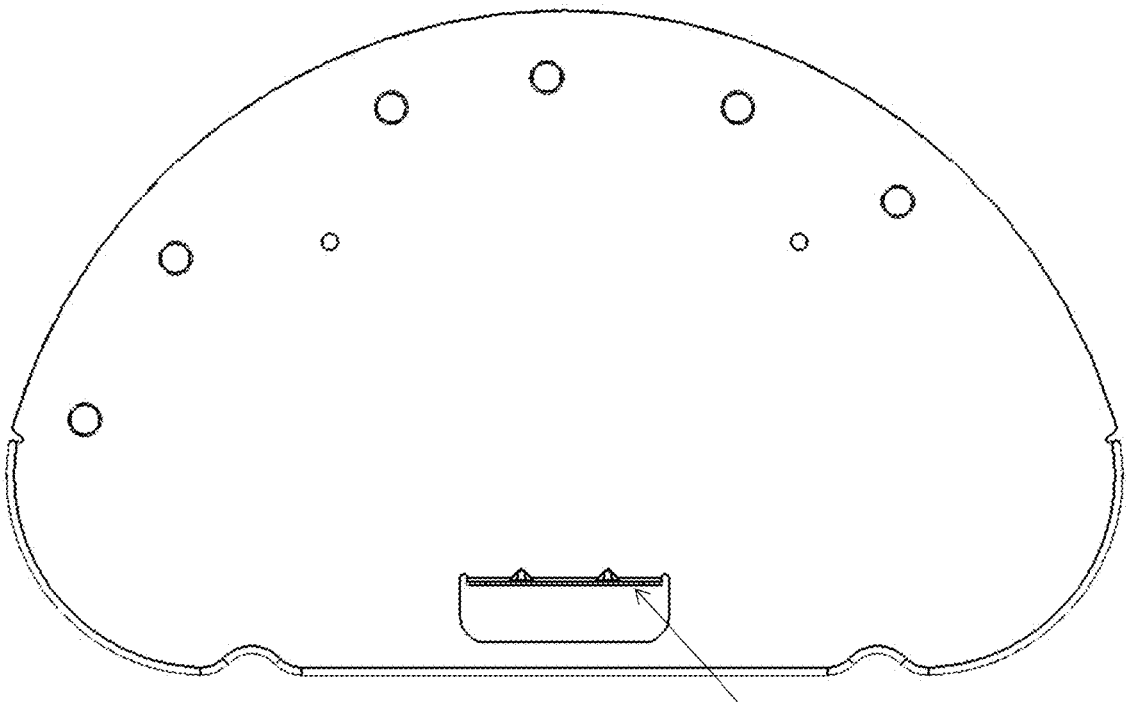

FIGS. 11A to 11G illustrate another example of an isolation plate, similar to that shown in FIGS. 10A and 10B. FIG. 11A is a perspective view of the isolation plate including a choke boundary region 1103. FIG. 11B is a front view and FIG. 11C is a back view. In use, an antenna section may be positioned on either or both of the front and back, and aligned so that the isolation choke region forms a top or bottom boundary perpendicular to the side walls and forming the reflector region from which the RF energy is emitted.

Figure 11D:
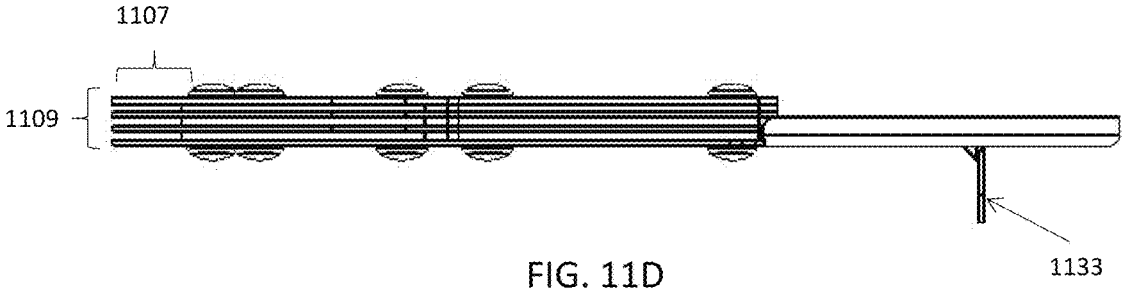
Figure 11E:
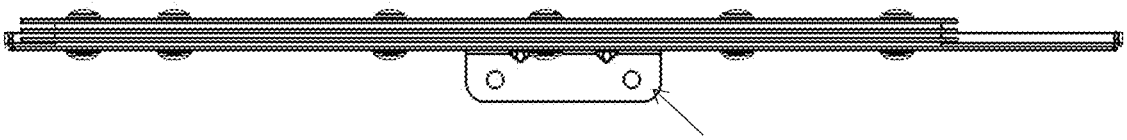

In FIG. 11D, a side view of the isolation plate shows the ridges 1107 formed by the stacks of plates 1109 that in turn form the choke region. FIG. 11E shows another side view, from the front of the isolation plate. The isolation plate may include an attachment 1133 or mounting region, which in this example is formed by a fold-out region of the plate.

FIGS. 11F and 11C shows side and front perspective exploded views of an isolation plate. In this example, as mentioned above, there are six strips 1141, 1142, 1141', 1142', 1141", 1142" of alternating sizes (e.g., thinner alternating with wider), so that the outer face of the isolation plate forms three ridges (recessed regions) as described above. The plates are all attached to each other (e.g., by bolts, screws, etc., shown in this example as bolts 1144).

Figure 12:
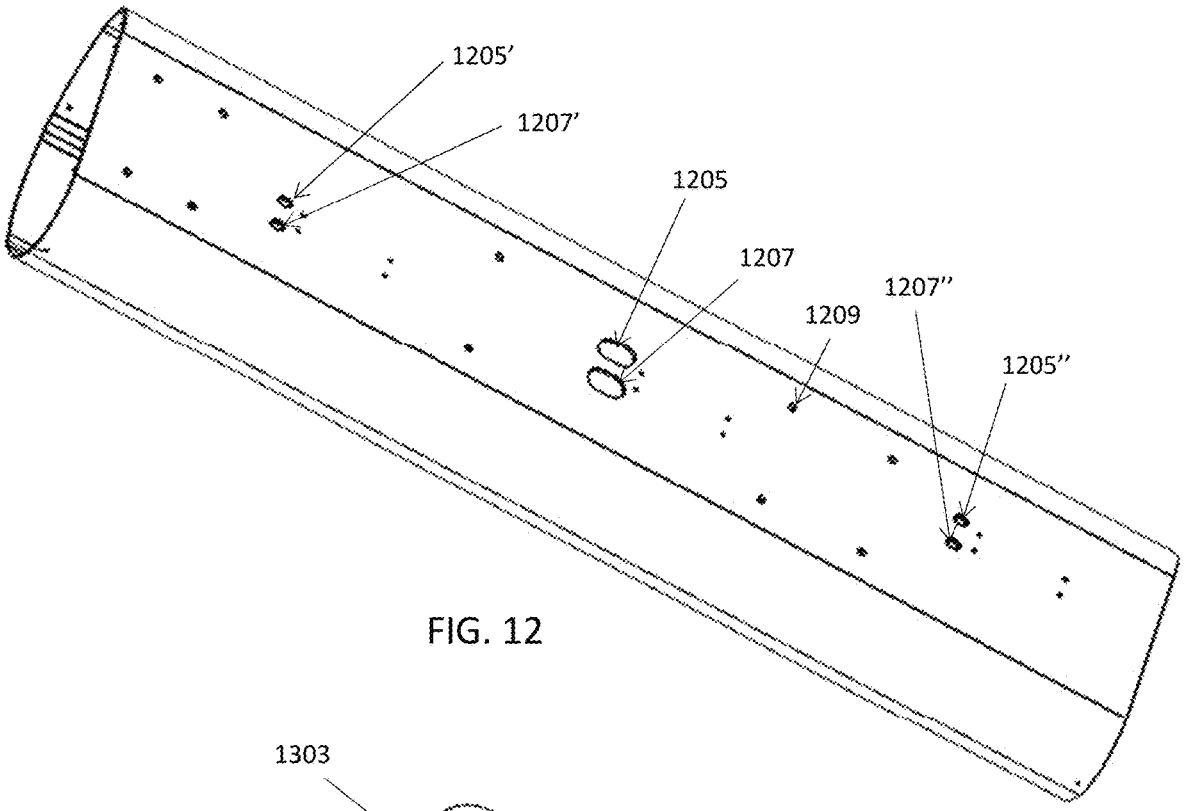
FIG. 12 is a perspective view of the outer housing of a multi-sector antenna array, shown from the back of the apparatus.

As mentioned above, any of the antenna assemblies described herein may include an outer cover (e.g., radome) that is at least partially transparent over the antenna reflectors for the wavelengths of RF energy being transmitted by the individual antenna sections. FIG. 12 illustrates one example of a cover (e.g., housing) 1202, shown from the back. The cover or housing may be unitary piece, as shown, forming an approximately cylindrical structure, or it may have any appropriate cross-section (e.g., be rectangular, triangular, circular, rentiform, deltoid, oblong, cordate, lanceolate, elliptical, cuneate, etc.). The back of the housing may include one or more openings for attachment to the RF radio transceiver(s) 1205, 1207, 1205', 1207', 1205", 1207" and/or openings for mounts 1209 for attaching the apparatus to a pole, wall, etc.

Figure 13A:
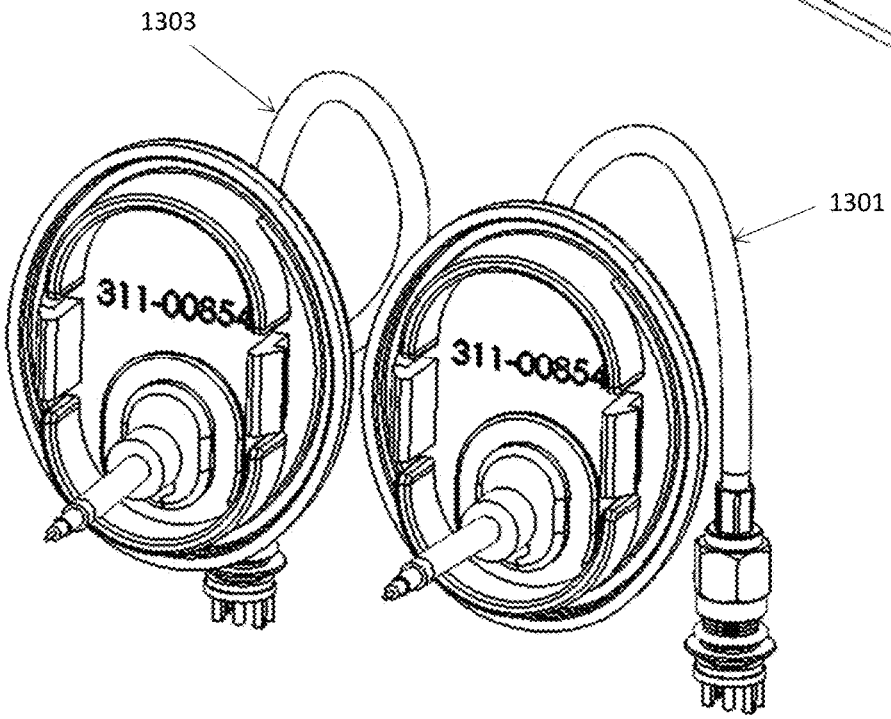
FIG. 13A shows perspective views of the cabling and connectors to couple a first radio apparatus to at least one of the antenna portions of a multi-sector antenna.
Figure 13B:
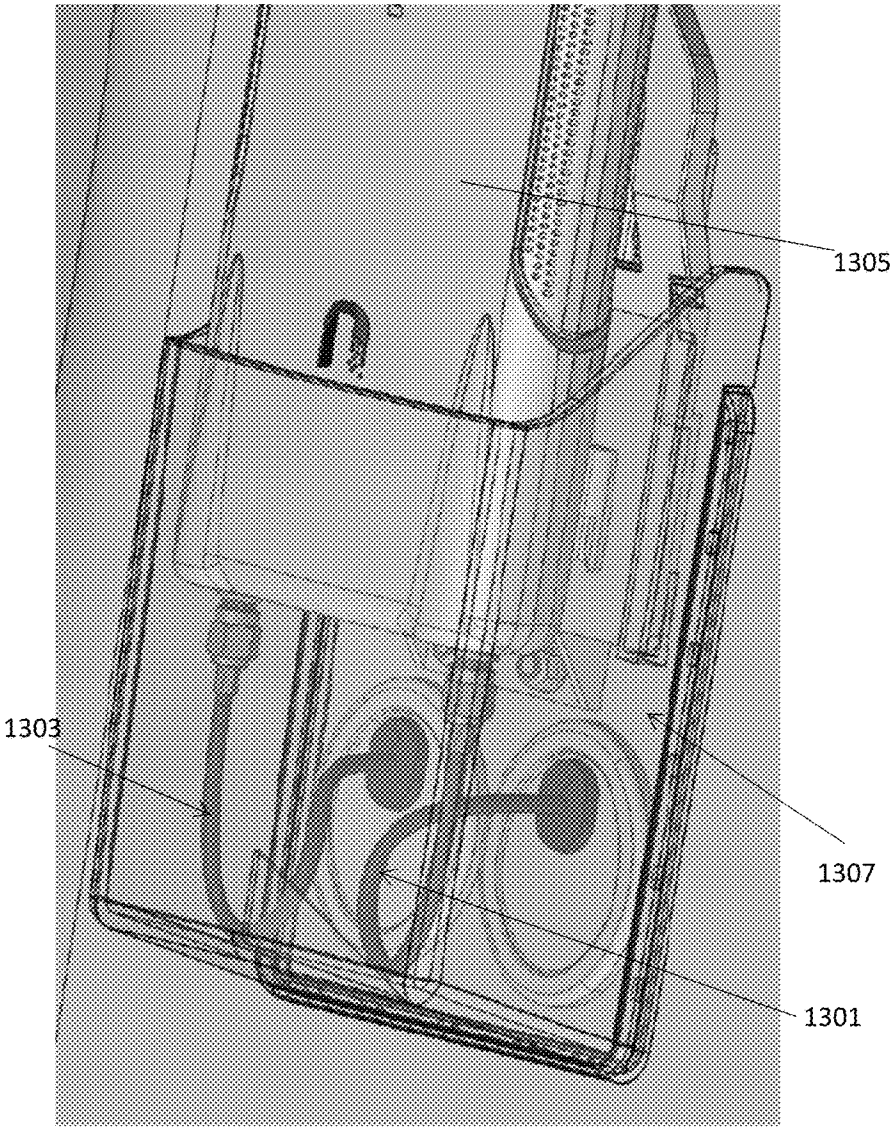
FIG. 13B illustrates the connection of a radio device to the antenna.

FIGS. 13A and 13B shows a pair of attachments 1301, 1303 that may connect a radio (transceiver) device 1305 held in a mount or attachment 1307 to the back of the apparatus, to one or more of the antenna sections (not shown).

Figure 15:
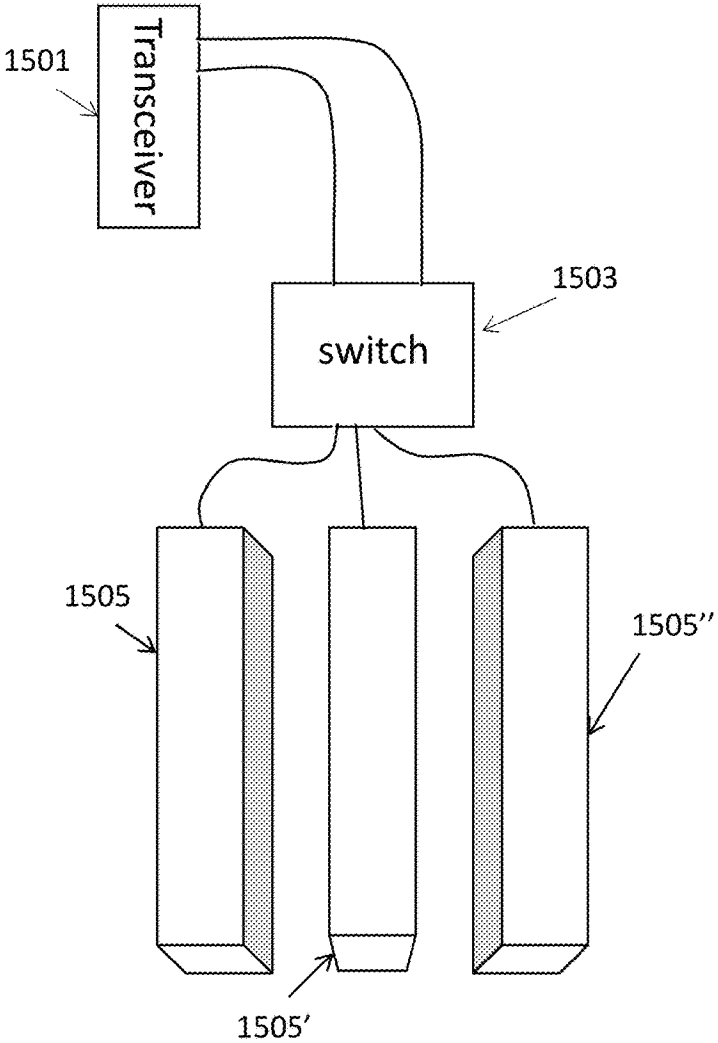
FIG. 15 is a schematic illustration of a single transceiver driving multiple antenna portions in a single antenna assembly.

As mentioned above, in some variations each antenna section is coupled to a transmitter/receiver/transceiver, thus each antenna section may include a separate transmitter/receiver/transceiver, although these separate transmitters may be connected to each other and/or controlled by controller. In some variations the transmission of RF signals from each antenna section may be specific to that sector, or it may be transmitted from all of the sectors, or some combination thereof. For example, in some variations, the antenna sections are operated simultaneously, e.g., the radiator arrays in the antenna sections may be driven by a single radio transceiver unit. In some variations, the antenna sections are operated individually. For example, each of the antenna section may be connected driven by a separate radio transceiver unit. In some variations one transceiver drives all or a subset of the antenna sections. For example, a single transceiver unit may drive one, two, three, four, etc. antenna sectors in a multi-sector antenna assembly, while in the same multi-sector antenna assembly, a second (or more) transceiver drives another one, two, three, four, etc. antenna sectors. FIG. 15, described in greater detail below, is one example of a single transceiver feeding three antenna portions (e.g., another antenna apparatus including a stacked array of individual antenna portions/sections that may be controlled, e.g., as an AP system).

FIG. 15 is an example of schematic of an antenna assembly that may be configured as a multi-sector, stacked antenna assembly as described herein, in which an RF transceiver (radio) may control a plurality (shown as three) of array antenna portions that may be stacked atop each other and isolated as described herein. In this example, each of the three antenna portions is a sector antenna 1505, 1505', 1505" that are connected to a single transceiver (radio device 1501 through a switch 1503. The system may be controlled to operate as an AP system, as described. e.g., in U.S. application Ser. No. 14/659,397, filed Mar. 16, 2015, titled "METHODS OF OPERATING AN ACCESS POINT USING A PLURALITY OF DIRECTIONAL BEAMS," Publication No. US-2015-0264584-A1 and herein incorporated by reference in its entirety.

Figure 14:
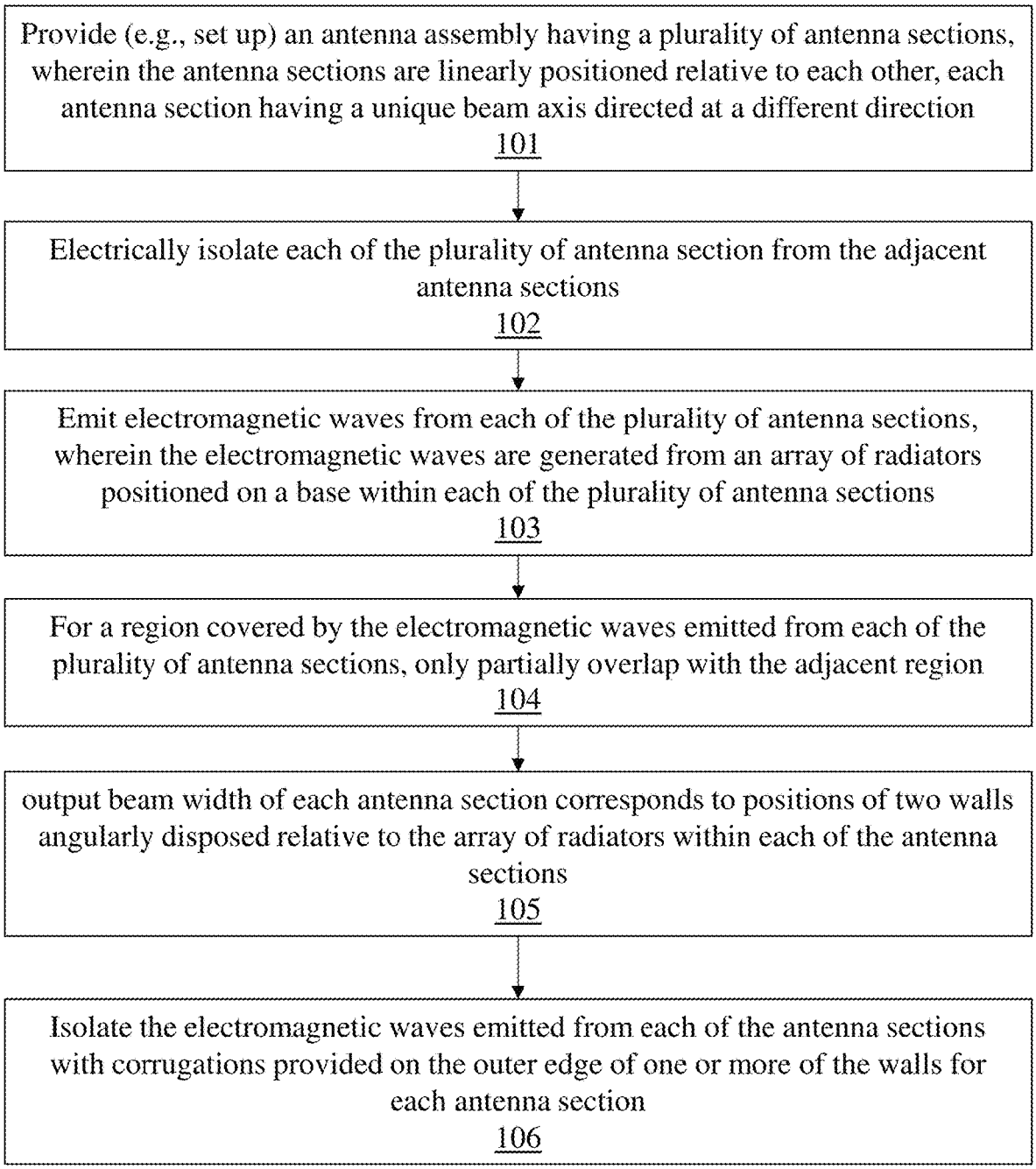
FIG. 14 is a diagram illustrating one variation of the operation of an antenna assembly as described herein.

In use, a sector antenna assembly such as the ones described herein may be configured to cover a broader geographic region than a single antenna. For example, as illustrated in FIG. 14, after providing a multi-sector antenna assembly such as the ones described herein, multiple region radio coverage may be provided by the standalone antenna structure 101. The antenna assembly may have a plurality of antenna sections, wherein the antenna sections are linearly positioned relative to each other. Each antenna section may have a unique beam axis directed at a different direction. Optionally, in some variations, each antenna sections may be electrically isolated from the adjacent antenna sections 102, or isolated (e.g., by the use of a choke boundary region) from other, nearby antennas. In addition, or alternatively, the main lobe of each antenna section may be somewhat isolated, so that each is limited in bandwidth (e.g., to the main lobe). Electromagnetic waves may then be emitted from all or some of the plurality of antenna sections, wherein the electromagnetic waves are generated from an array of radiators positioned on a base within each of the plurality of antenna sections 103. As mentioned, the emitted RF energy may be the same for each antenna section, or it may be specific to a particular section or sub-set of the sections. Because of the configuration and arrangement of the antenna sections, transmission may be limited to a region covered by the electromagnetic waves emitted from each of the plurality of antenna sections, as there is only partial overlap with the other antenna regions. For example, the output beamwidth of each antenna section may correspond to the position of the two walls angularly disposed relative to the array of radiators within each of the antenna section. The choke boundary (corrugations) may help isolate the electromagnetic energy from each of the antenna sections to limit the bandwidth of each section. For example, in some variations, the output beamwidth for each antenna section is between 20 and 180 degrees (e.g., 60 degrees, 80 degrees, 90 degrees, etc.).

The above illustration provides many different embodiments or embodiments for implementing different features of the invention. Specific embodiments of components and processes are described to further explain the invention. These are, of course, merely embodiments and are not intended to limit the invention from that described in the claims.

Although the invention is illustrated and described herein as embodied in one or more specific examples, it is nevertheless not intended to be limited to the details shown, since various modifications and structural changes may be made therein without departing from the spirit of the invention and within the scope and range of equivalents of the claims. Accordingly, it is appropriate that the appended claims be construed broadly and in a manner consistent with the scope of the invention, as set forth in the following claims.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected". "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Terminology used herein is for the purpose of describing particular embodiments only and is not intended to be limiting of the invention. For example, as used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be abbreviated as "/".

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

Although the terms "first" and "second" may be used herein to describe various features/elements (including steps), these features/elements should not be limited by these terms, unless the context indicates otherwise. These terms may be used to distinguish one feature/element from another feature/element. Thus, a first feature/element discussed below could be termed a second feature/element, and similarly, a second feature/element discussed below could be termed a first feature/element without departing from the teachings of the present invention.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Although various illustrative embodiments are described above, any of a number of changes may be made to various embodiments without departing from the scope of the invention as described by the claims. For example, the order in which various described method steps are performed may often be changed in alternative embodiments, and in other alternative embodiments one or more method steps may be skipped altogether. Optional features of various device and system embodiments may be included in some embodiments and not in others. Therefore, the foregoing description is provided primarily for exemplary purposes and should not be interpreted to limit the scope of the invention as it is set forth in the claims.

The examples and illustrations included herein show, by way of illustration and not of limitation, specific embodiments in which the subject matter may be practiced. As mentioned, other embodiments may be utilized and derived there from, such that structural and logical substitutions and changes may be made without departing from the scope of this disclosure. Such embodiments of the inventive subject matter may be referred to herein individually or collectively by the term "invention" merely for convenience and without intending to voluntarily limit the scope of this application to any single invention or inventive concept, if more than one is, in fact, disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

What is claimed is:

1. An antenna assembly having a first vertical axis, the antenna assembly comprising:

three or more antenna sections arranged atop each other along the first vertical axis, each antenna section including:

a reflector;

a radiator array, positioned at a base of the reflector; and an isolation plate configured to reduce interference from adjacent antenna sections, the isolation plate including:

a plurality of stacked layers of material, wherein outer edges of adjacent stacked layers alternate by a distance of about ¼ wavelength of signals transmitted by the antenna assembly, wherein each antenna section is oriented along the first vertical axis so that an output beam axis of each antenna section is directed toward different directions with respect to any other antenna section of the antenna assembly.

2. The antenna assembly claim 1, wherein the output beam axis of each antenna section is separated from other antenna sections by at least ten degrees.

3. The antenna assembly of claim 1, wherein for each antenna section the reflector comprises two walls configured to extend from the base of the reflector.

4. The antenna assembly of claim 1, wherein each antenna section the reflector further comprises:

two walls positioned perpendicular to the isolation plate; and a corrugation configured to extend along an outer edge of the isolation plate between the walls of the reflector.

5. The antenna assembly of claim 1, wherein the radiator array comprises a line of disks-shaped emitters.

6. The antenna assembly of claim 1, wherein each antenna section comprises an elongate trough extending in the first vertical axis formed by a first wall and a second wall.

7. The antenna assembly of claim 1, wherein each antenna section comprises an elongate trough extending in the first vertical axis formed by a first wall and a second wall, the first and second walls configured to extend from the base, and an opening into the elongate trough between the first wall and the second wall, wherein the opening has a width that is larger than a width of the base.

8. The antenna assembly of claim 1, wherein each antenna section comprises an elongate trough extending in the first vertical axis formed by a first wall and a second wall, the first and second walls configured to extend from the base, and an opening into the elongate trough between the first wall and the second wall, wherein the opening has a width that is larger than a width of the base, further comprising a first corrugation disposed on an edge of the first wall opposite the base, and a second corrugation disposed on an edge of the second wall opposite the base.

9. The antenna assembly of claim 1, wherein each antenna section comprises an elongate trough extending in the first vertical axis formed by a first wall and a second wall, the first and second walls configured to extend from the base, and an opening into the elongate trough between the first wall and the second wall, wherein the opening has a width that is larger than a width of the base, further comprising a first corrugation disposed on an edge of the first wall opposite the base, and a second corrugation disposed on an edge of the second wall opposite the base, further wherein the first corrugation and the second corrugation of each antenna section each comprise a plurality of ridges extending in the first vertical axis.

10. The antenna assembly of claim 1, further comprising a radome positioned over the antenna assembly covering the reflectors of each of the antenna sections.

11. The antenna assembly of claim 1, wherein the antenna sections have identical output beamwidths.

12. The antenna assembly of claim 1, wherein an output beamwidth for each antenna section is 60 degrees.

13. The antenna assembly of claim 1, wherein a combined beamwidth of all the antenna sections is 90 degrees.

14. The antenna assembly of claim 1, wherein a beam axis of a first antenna section is radially separated by 30 degrees from a beam axis of a second antenna section and 60 degrees from a beam axis of a third antenna section.

15. The antenna assembly of claim 1, wherein a beam axis of a first antenna section is radially separated by 30 degrees from a beam axis of a second antenna section and 60 degrees from a beam axis of a third antenna section, further wherein the second antenna section is positioned between the first and third antenna sections.

16. The antenna assembly of claim 1, wherein a beam axis of a first antenna section is radially separated by 30 degrees from a beam axis of a second antenna section and 60 degrees from a beam axis of a third antenna section, further wherein the first antenna section is positioned between the second and third antenna sections.

17. The antenna assembly of claim 1, wherein a beam axis of a first antenna section is radially separated by 30 degrees from a beam axis of a second antenna section and 60 degrees from a beam axis of a third antenna section, further wherein the third antenna section is positioned between the first and second antenna sections.

18. The antenna assembly of claim 1, wherein each antenna section has varying output beamwidths.

19. The antenna assembly of claim 1, wherein at least two of the antenna sections have identical beamwidths.

20. The antenna assembly of claim 1, wherein the ¼ wavelength is an average, median, or mean of the signals transmitted by the antenna assembly.

* * * * *